US011986134B2

(12) United States Patent
Matsuo et al.

(10) Patent No.: US 11,986,134 B2
(45) Date of Patent: May 21, 2024

(54) SHEET DISPENSING DEVICE

(71) Applicant: MATSUO INDUSTRIES, INC., Nagoya (JP)

(72) Inventors: Motoi Matsuo, Obu (JP); Yuji Sekitomi, Obu (JP); Mikiya Ichikawa, Obu (JP); Kazushi Akutsu, Obu (JP); Noriyuki Heike, Obu (JP)

(73) Assignee: MATSUO INDUSTRIES, INC., Nagoya (JP)

( * ) Notice: Subject to any disclaimer, the term of this patent is extended or adjusted under 35 U.S.C. 154(b) by 661 days.

(21) Appl. No.: 17/269,621

(22) PCT Filed: Aug. 19, 2019

(86) PCT No.: PCT/JP2019/032256
§ 371 (c)(1),
(2) Date: Feb. 19, 2021

(87) PCT Pub. No.: WO2020/040083
PCT Pub. Date: Feb. 27, 2020

(65) Prior Publication Data

US 2021/0196086 A1 Jul. 1, 2021

(30) Foreign Application Priority Data

Aug. 21, 2018 (JP) ..... 2018-155051

(51) Int. Cl.
*A47K 10/34* (2006.01)
*A47K 7/00* (2006.01)
(Continued)

(52) U.S. Cl.
CPC ..... *A47K 7/00* (2013.01); *A47K 10/3606* (2013.01); *B65D 83/0894* (2013.01); *A47K 2010/3668* (2013.01)

(58) Field of Classification Search
CPC ..... A47K 7/00; A47K 10/3606; A47K 2010/3266; A47K 2010/3668; B65D 83/0894
See application file for complete search history.

(56) References Cited

U.S. PATENT DOCUMENTS

2004/0134924 A1* 7/2004 Hansen ..... A47K 10/36 221/9
2013/0334357 A1 12/2013 Huruse
(Continued)

FOREIGN PATENT DOCUMENTS

JP 2004-505743 A 2/2004
JP 2012-070887 A 4/2012
(Continued)

OTHER PUBLICATIONS

International Search Report issued on Oct. 15, 2019 in corresponding International application No. PCT/JP2019/032256; 4 pages.
(Continued)

*Primary Examiner* — James O Hansen
(74) *Attorney, Agent, or Firm* — Maier & Maier, PLLC

(57) ABSTRACT

To dispense a predetermined length of a sheet hygienically. In a sheet dispensing device, a sheet feeding mechanism feeds out a predetermined length for use of a sheet from a sheet dispensing port, and at this time, a part, of the sheet, located upstream of the sheet dispensing port in terms of a feeding direction of the sheet is held by a driving roller and a driven roller. The driven roller is biased by leaf springs to be pressed toward the driving roller. Consequently, the sheet is dispensed while hanging down from the sheet dispensing port. When a user pulls down the hanging sheet while holding it, the sheet is cut from the vicinity of a held part, so that the user can take the predetermined length for use of the sheet hygienically.

9 Claims, 20 Drawing Sheets

(51) Int. Cl.
*A47K 10/36* (2006.01)
*B65D 83/08* (2006.01)

(56) References Cited

U.S. PATENT DOCUMENTS

| | | | | |
|---|---|---|---|---|
| 2014/0312158 | A1* | 10/2014 | Hlushchenko | A47K 10/34 29/601 |
| 2016/0262580 | A1* | 9/2016 | Fellhoelter | A47K 10/3687 |
| 2017/0042390 | A1* | 2/2017 | Rubenson | A47K 10/32 |
| 2018/0177348 | A1* | 6/2018 | Swanson | A47K 10/3625 |

FOREIGN PATENT DOCUMENTS

| | | | | |
|---|---|---|---|---|
| JP | 2014-196112 | A | 10/2014 | |
| JP | 5799450 | B2 | 10/2015 | |
| JP | 2016-116637 | A | 6/2016 | |
| JP | 2016-225859 | A | 12/2016 | |
| WO | WO 9959457 | * | 11/1999 | A47K 10/36 |
| WO | 2002/015763 | A1 | 2/2002 | |

OTHER PUBLICATIONS

Written Opinion of the International Searching Authority issued on Oct. 15, 2019 in corresponding International application No. PCT/JP2019/032256; 4 pages.

* cited by examiner (a)

(b)

(a)

(b)

(a)

(b)

(a)

(b)

SHEET DISPENSING DEVICE

TECHNICAL FIELD

The present invention relates to a device for dispensing a sheet used to wipe hands and the like.

BACKGROUND

Wet sheets (including those called wet tissues, wet towels, and the like) made of paper, nonwoven fabric, or the like impregnated with a liquid chemical that are used for wiping hands or the like are typically stacked and stored in plurality in a bag body, and at the time of the use, a lid member provided on an opening of the bag body is opened/closed and the wet sheets are taken out sheet by sheet, as is disclosed in Japanese Patent Application Laid-open No. 2014-196112. However, in the case where the stacked wet sheets stored in the bag body are taken out sheet by sheet from the opening, a user needs to hold the bag body with his/her hand because the bag body moves up with the wet sheet that is tried to be taken out. Accordingly, in a case where the bag body is installed in restrooms, washrooms, on dining tables, and the like in places where many unspecified people gather, such as public facilities, hospitals, hotels, department stores, restaurants, parks, trains, and airplanes, the user may feel hesitant to hold the bag body or the like with his/her hand because of a hygienic reason.

In consideration of the above, the present applicant has proposed, in Japanese Patent Application Laid-open No. 2016-116637, a sheet dispenser that automatically dispenses a plurality of wet sheets in a folded and stacked state sheet by sheet. According to this sheet dispenser, a user need not hold a case of the sheet dispenser and can pick up only the wet sheet transferred to an outlet. This is hygienic and enables the user to easily take the wet sheet even in a situation where only one hand is available.

Further, Japanese Patent No. 5799450 discloses a mechanism that automatically feeds a predetermined amount of toilet paper and cuts it at a predetermined position with a rotary blade or the like.

SUMMARY

From the sheet dispenser disclosed in Patent Document 2, a user can take the wet sheet easily and hygienically as described above, but since a certain number of the stacked wet sheets are picked up at a time, an adjusting mechanism or the like is necessary when their bulk becomes small and the structure tends to be complicated. Further, since the wet sheet is transferred up to a receiving tray disposed at the outlet and the user picks up the wet sheet on the receiving tray with his/her hand, the hand may touch the receiving tray at this time, leaving room for further improvement from a hygienic viewpoint.

Further, Patent Document 3 relates to toilet paper, and it is possible to automatically dispense a predetermined length of a rolled sheet (toilet paper) that is to be dispensed, each time. However, because of a need for a cutting mechanism such as the rotary blade, the structure is complicated, and there is a risk of injury due to the touching of the rotary blade at the time of maintenance work and so on. Further, the mechanism of Patent Document 3 is configured such that, after the toilet paper is cut into a predetermined length by the cutting mechanism, the cut toilet paper is held on a receiving tray, and accordingly the user's hand etc. may touch the receiving tray, also leaving room for improvement from a hygienic viewpoint.

The present invention was made in consideration of the above and has an object to provide a sheet dispensing device having a simple structure yet capable of dispensing a predetermined length of a sheet hygienically, in particular, suitable for dispensing a wet sheet.

Means for Solving the Problem

To solve the above problems, a sheet dispensing device of the present invention includes:

- a casing capable of housing a rolled sheet inside and including a sheet dispensing port which is formed at a predetermined height position to face downward and through which the sheet passes when fed out; and
- a sheet feeding mechanism which is provided in the casing, and when the sheet dispensing device is used, feeds out a predetermined length for use of the sheet from the sheet dispensing port, and dispenses the predetermined length for use, in a hanging state from the sheet dispensing port while holding a part, of the sheet, located upstream of the sheet dispensing port in terms of a feeding direction of the sheet.

Preferably, the sheet feeding mechanism includes:

- a driving roller which is disposed upstream of the sheet dispensing port in terms of the feeding direction of the sheet and around whose outer peripheral surface the sheet is wound;
- a driven roller which faces the driving roller to sandwich the sheet between itself and the driving roller; and
- a drive control part which rotates the driving roller in such a direction as to feed the sheet toward the sheet dispensing port, and
- the driven roller is supported by an elastic member to be elastically biased in a direction in which the driven roller approaches the driving roller, and when the driving roller stops rotating, the part located upstream of the sheet dispensing port in terms of the feeding direction of the sheet is held while sandwiched between the driving roller and the driven roller.

Preferably, the drive control part includes a feed amount detecting part which controls an amount of the sheet fed per time to control the sheet's length for use that is to be hung down from the sheet dispensing port.

Preferably, as the sheet, one in which cutting lines extending between edges of the sheet are formed at predetermined intervals in the feeding direction is used, and the drive control part stops driving the driving roller when the feed amount detecting part detects a predetermined number of the cutting lines in the feeding direction after the driving roller starts rotating.

Preferably, the sheet dispensing device includes a resistance applying part which applies a predetermined resistance to the sheet to widen slits forming the cutting line when the sheet is transferred toward the sheet dispensing port.

Preferably, the sheet dispensing device includes a sheet cartridge disposed in the casing, housing the rolled sheet, and including a cover having a pullout port from which the sheet is pulled out, and

- the sheet feeding mechanism pulls the sheet out of the sheet cartridge from the pullout port and feeds the sheet to the sheet dispensing port.

Preferably, the sheet dispensing device includes a sheet cartridge disposed in the casing, housing the rolled sheet, and including a cover having a pullout port from which the sheet is pulled out, and an elastic contact piece which comes into contact with the sheet is provided as the resistance applying part at the pullout port.

Preferably, the sheet dispensing device further includes a fracture preventing auxiliary roller provided between the elastic contact piece and the driving roller to prevent a fracture along the cutting line.

Preferably, the fracture preventing auxiliary roller is provided at such a position as to make a range, of the sheet, from the pullout port to the fracture preventing auxiliary roller extend substantially horizontally.

Preferably, a rotation assisting means for assisting the rotation of the rolled sheet when the sheet is fed out is provided in the sheet cartridge.

Preferably, the casing includes:

a main body case in which the sheet cartridge is disposed and which has the sheet dispensing port; and a lid which is capable of separating from and coming into contact with the main body case and covers, from above, the sheet that is present at least in a range from the pullout port of the sheet cartridge from which the sheet has been pulled out up to the sheet dispensing port, the driving roller and the driven roller are supported by one and the other of the main body case and the lid respectively, and when the lid is joined to the main body case, the driving roller and the driven roller face each other with the sheet therebetween.

Preferably, the drive control part has a hand etc. detecting sensor which is attached to an appropriate part of the casing to detect the presence of a user's hand etc., and the drive control part rotates the driving roller when the hand etc. detecting sensor detects the presence of the user's hand etc.

The sheet dispensing device of the present invention is preferable for a wet sheet.

The casing can include an information display part. Further, the sheet dispensing device may be configured to be connectable to a mobile terminal including an information display part.

According to the sheet dispensing device of the present invention, when it is used, the sheet feeding mechanism feeds out a predetermined length for use of the sheet from the sheet dispensing port, and at this time, the sheet is dispensed in a hanging state from the sheet dispensing port while its part located upstream of the sheet dispensing port in terms of the feeding direction of the sheet is held. Therefore, when the user pulls the hanging sheet slightly downward while holding it, the sheet is cut at a position near the held part, and the user can take the predetermined length for use of the sheet. The predetermined length of the sheet is dispensed in the hanging state from the sheet dispensing port, that is, the sheet is not dispensed while in contact with some member such as a receiving tray as is conventionally but is dispensed in a non-contact state, as it were, in the air. Therefore, the user need not touch a part other than the sheet, which is very hygienic.

Further, the use of the rolled sheet as the sheet put in the casing enables the sheet feeding mechanism to have both a sheet feeding function and a function of holding the sheet at a more inward position than the sheet dispensing port, and thus the whole structure is simple, contributing to size reduction and cost reduction. Besides, since the sheet feeding mechanism is located at the more inward position than the sheet dispensing port, the user does not touch it, which is also hygienic. Further, the sheet feeding mechanism only needs to have the aforesaid sheet feeding function and sheet holding function, and a mechanism for cutting the sheet such as a cutter is not necessary, making it possible to improve safety at the time of maintenance work.

Further, the sheet dispensing device of the present invention is capable of dispensing the sheet without necessitating the user to touch a part other than the sheet as described above, and thus is especially suitable for dispensing a wet sheet impregnated with a liquid chemical and desired to be used hygienically. Further, since there is no cutting mechanism and the hanging sheet is cut by being pulled, a wet sheet is more easily cut than a dry sheet, and in this respect as well, the present invention is suitable for a wet sheet.

BRIEF DESCRIPTION OF THE DRAWINGS

FIG. 10(*b*) is an explanatory perspective view, seen from a front lower direction, of the operation of the sheet dispensing device of the embodiment.

FIG. 13(*b*) is a further enlarged view of the vicinity of a pullout port of a sheet cartridge and a fracture preventing auxiliary roller.

FIG. 14(*b*) is a plan view of the sheet cartridge.

FIG. 15(*b*) is a view illustrating an example in which a mobile terminal of a user is connectable.

FIG. 17(*b*) is a perspective view illustrating its outer appearance seen from a front lower direction.

FIG. 18(*b*) is a rear view of the sheet dispensing device according to the still another embodiment FIG. 19(*a*) is a plan view of the sheet dispensing device according to the still another embodiment.

FIG. 19(*c*) is a bottom view of the sheet dispensing device according to the still another embodiment.

FIG. 20(*b*) is a perspective view of the sheet dispensing device according to the still another embodiment seen from the rear lower direction in FIG. 20(*a*).

DETAILED DESCRIPTION OF THE EMBODIMENTS

Figure 1:
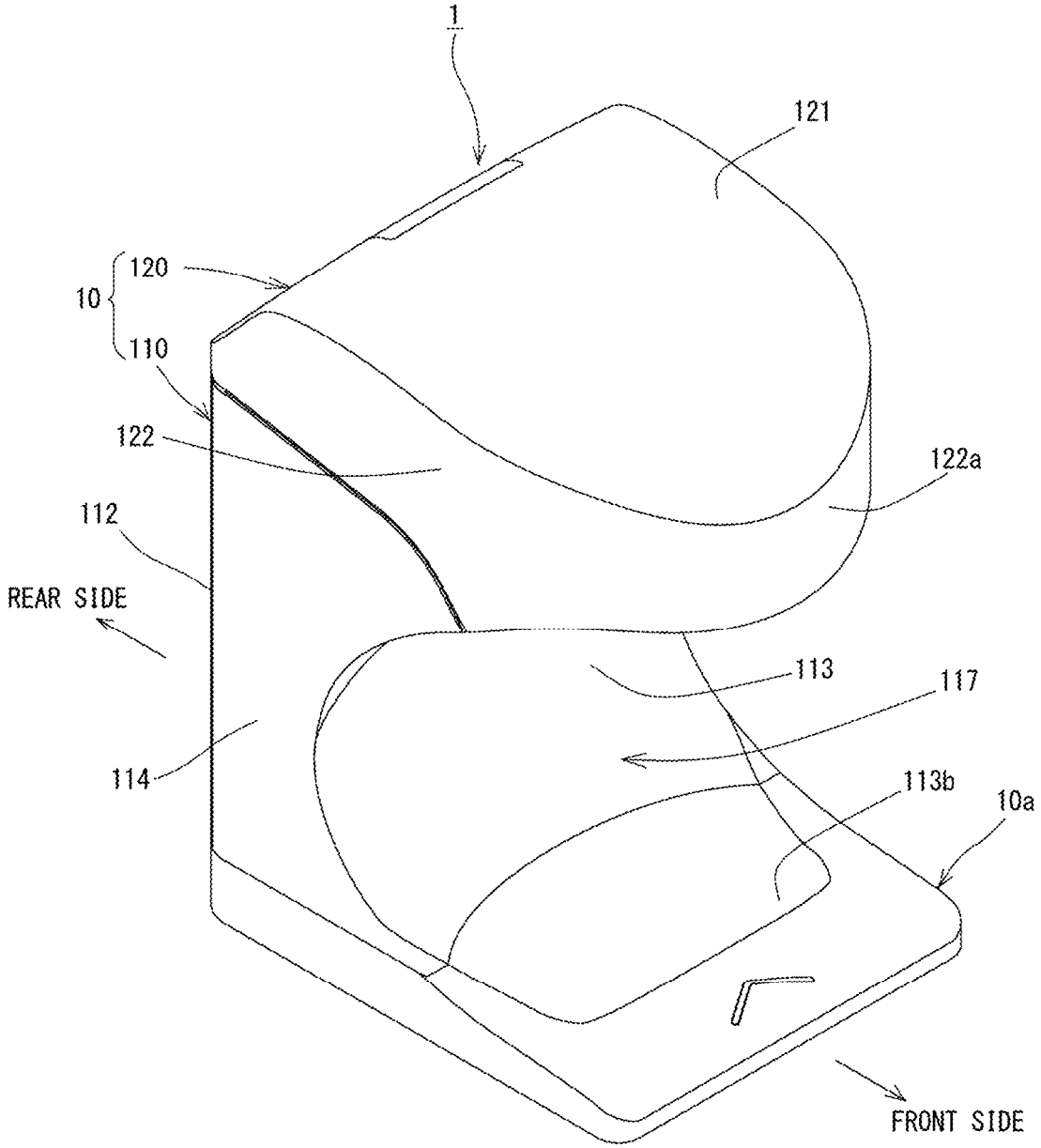
FIG. 1 is a perspective view illustrating the outer appearance of a sheet dispensing device according to one embodiment of the present invention seen from a front upper direction.

Embodiments of the present invention will be hereinafter described in more detail based on the drawings. As illustrated in FIG. 1 to FIG. 10, a sheet dispensing device 1 of this embodiment includes a casing 10 and a sheet feeding mechanism 20.

The casing 10 includes a main body case 110 and a lid 120. As illustrated in FIG. 1 to FIG. 4, outwardly, the main body case 110 has a substantially rectangular shape that is slightly longer in the height direction in a rear view and a front view, and is in a substantially rectangular shape that is slightly longer in the front-rear direction in a plan view and a bottom view. On the other hand, in a side view, it has a shape cut out in an arc shape from the front side toward the rear side. Specifically, it is formed in a hollow shape that is surrounded by a bottom surface 111 in a substantially rectangular shape that is slightly longer in the front-rear direction in a plan view, a substantially rectangular rear surface 112 rising on the rear side of the bottom surface 111 substantially vertically to the bottom surface 111, a curved front surface 113 located on the front side and formed substantially in a C shape with its heightwise substantially middle portion curving rearward, and side surfaces 114, 114 covering side portions of the rear surface 112 and the curved front surface 113, and that has an opening 115 in an upper surface.

In this structure, in the curved front surface 113, a portion above the substantially heightwise middle portion is an upper projecting surface 113*a* that gradually projects forward and a portion under the substantially heightwise middle portion is a lower projecting surface 113*b* that gradually projects more forward as it goes toward the bottom surface 111 and covers the bottom surface 111. Accordingly, in front of the curved front surface 113, a front-side space 117 dented rearward substantially in an arc shape is formed between the upper projecting surface 113*a*, of the curved front surface 113, projecting forward and the bottom surface 111. Further, in the upper projecting surface 113*a* of the curved front surface 113, a sheet dispensing port 113*c* facing downward, that is, facing the front-side space 117 is formed in a slit shape in the width direction (see FIG. 2). Note that the bottom surface 111 and the lower projecting surface 113*b* covering it constitute a base 10*a* when the casing 10 is put on a washstand or the like.

As illustrated in FIG. 3 to FIG. 7, in the main body case 110, a sheet cartridge 130 is stored through the opening 115. The sheet cartridge 130 has a cover 131 which is substantially rectangular parallelepiped-shaped as a whole, and a rolled sheet (wet sheet S in this embodiment) is stored in the cover 131 (see FIG. 7).

In the cover 131, a slit-shaped pullout port 131*a* extending in a substantially horizontal direction is formed at its part on the front side of the main body case 110 (see FIG. 3 and FIG. 6), and a leading edge of the wet sheet S faces the pullout port 131*a* so that the wet sheet S can be pulled out. The cover 131 except the pullout port 131*a* is airtightly closed. Further, before the sheet cartridge 130 is used, that is, at a stage before the sheet cartridge 130 is set in the main body case 110, the sheet cartridge 130 is provided in a state in which the pullout port 131*a* is also airtightly closed with, for example, a sealing tape (not illustrated). Therefore, before the sheet cartridge 130 is set in the main body case 110, the wet sheet S is stored in the airtightly closed space with the pullout port 131*a* being closed as well, so that the wet sheet S is less dried. Further, though the aforesaid sealing tape or the like closing the pullout port 131*a* is removed when the sheet cartridge 130 is set in the main body case 110, the wet sheet S is surrounded by the cover 131 excluding the pullout port 131*a* and thereafter is covered with the lid 120 of the casing 10 from above, so that the wet sheet S is still kept in an environment where it does not readily become dry even after the start of the use.

Incidentally, the cover 131 of the sheet cartridge 130 may be of a disposable type made of, for example, a flexible film and discarded after the stored wet sheet S is used up, or may be of a type made of hard resin or the like and repeatedly usable when the wet sheet S is stored again, or the like.

Figure 3:
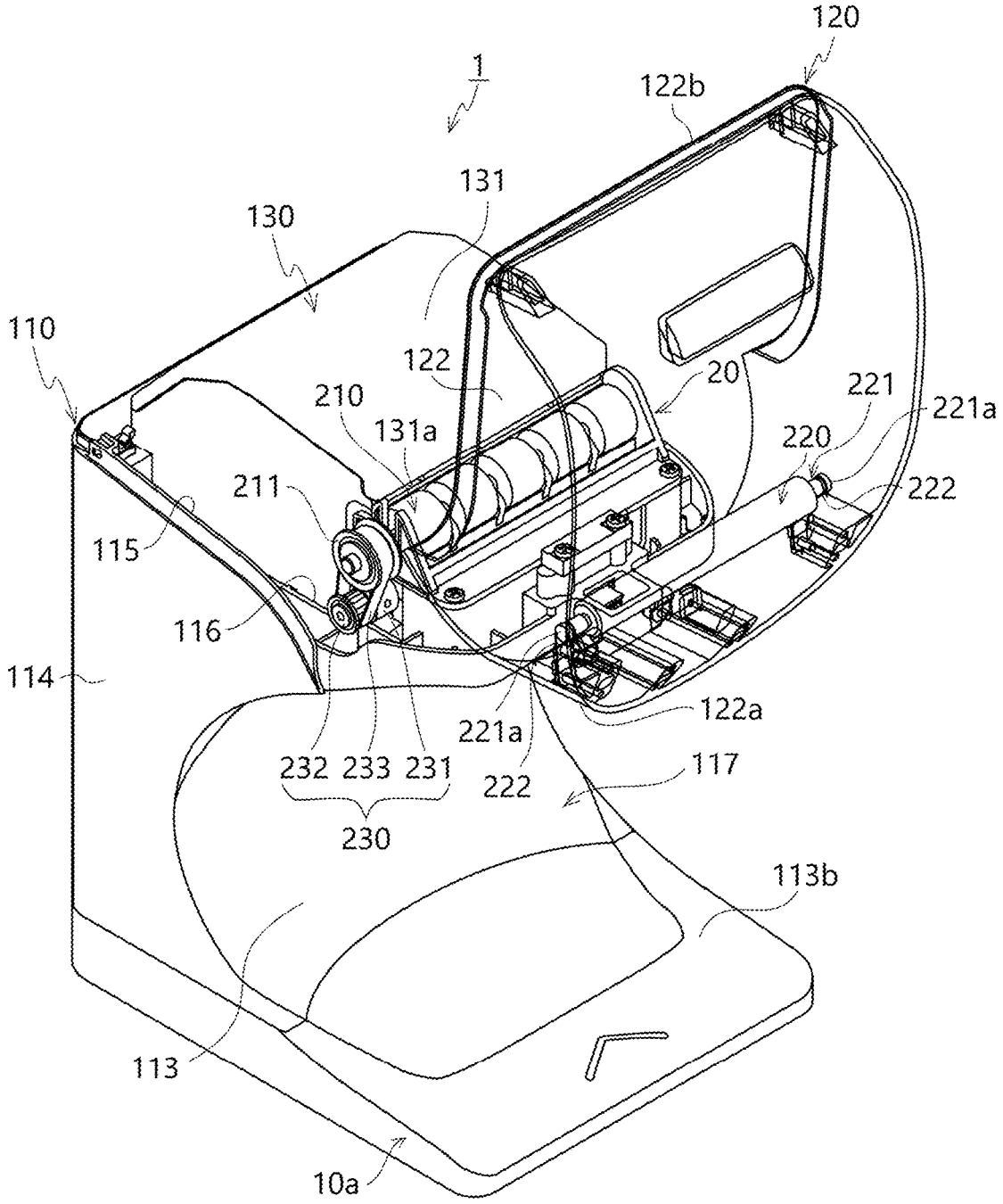
FIG. 3 is a perspective view illustrating the internal structure of the sheet dispensing device of the embodiment partly in a transparent state with its lid being opened.
Figure 4:
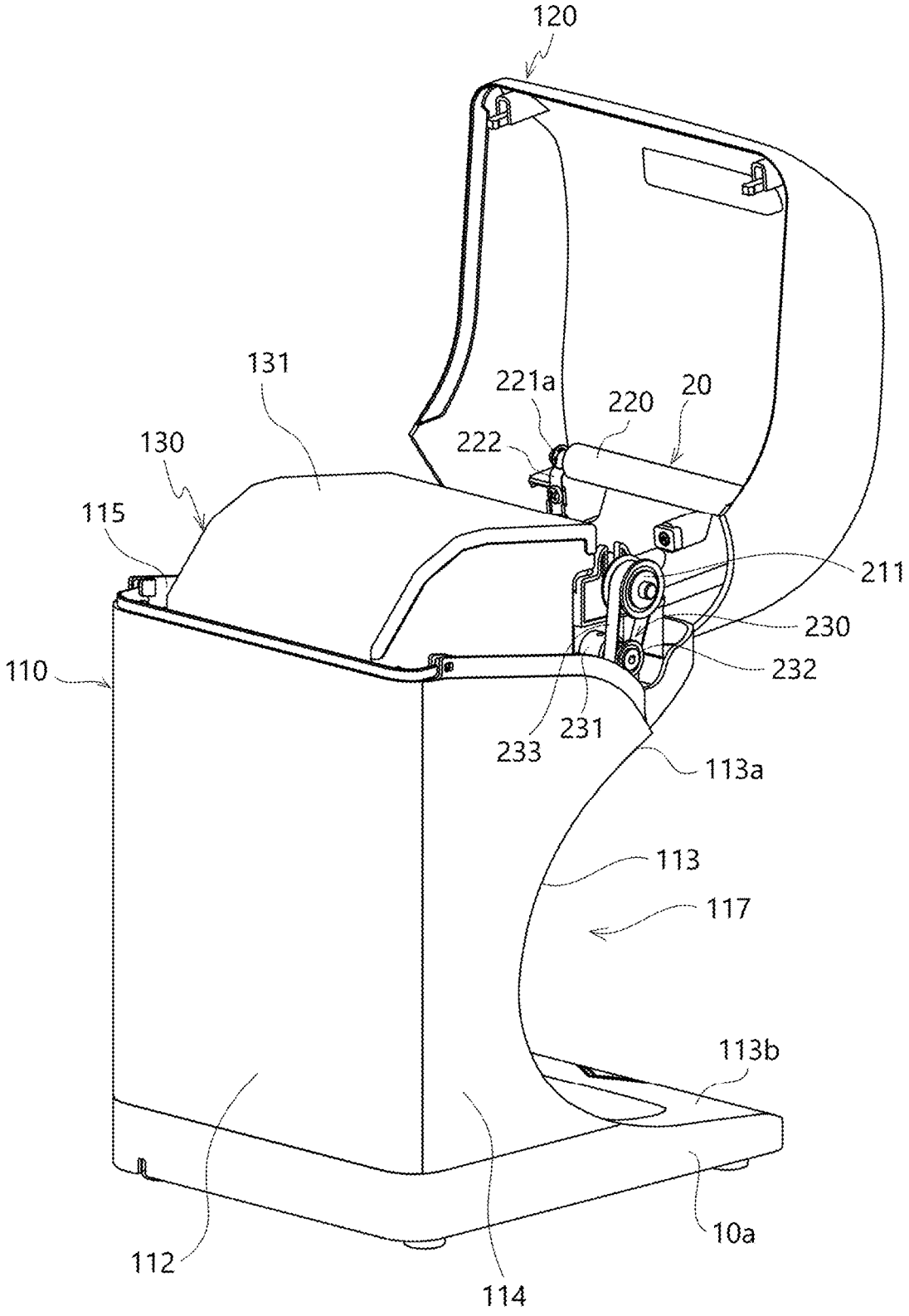
FIG. 4 is a perspective view seen from the rear side in FIG. 3.
Figure 5:
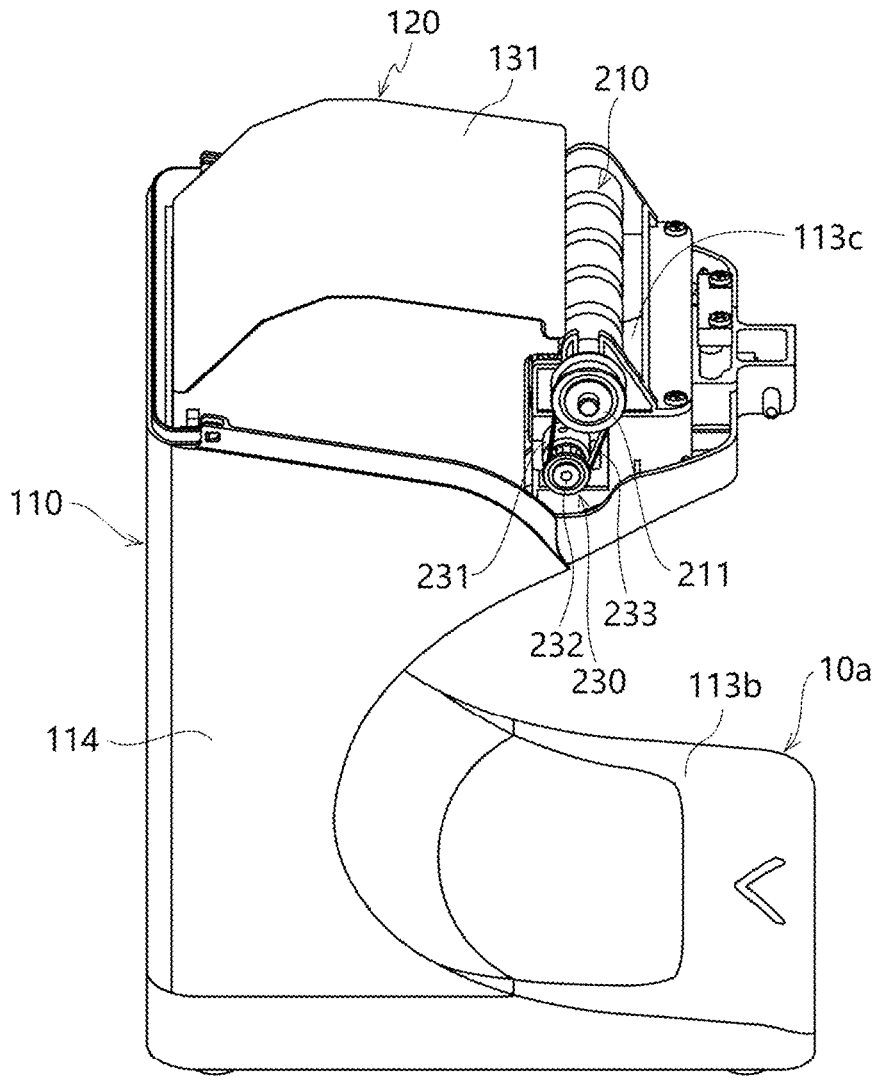
FIG. 5 is a view illustrating, in detail, the structure of a drive control part and a driving roller which are disposed in a main body case of the sheet dispensing device.

As illustrated in FIG. 3 and FIG. 4, from the position of the rear surface 112 of the main body case 110, the front-rear direction length of the sheet cartridge 130 is shorter than the length of the lid 120 up to its tip position (position of a later-described front plate 122*a* located on the front side), and the sheet cartridge 130 is placed on a sheet placement part 116 provided closer to the rear surface 112 in the main body case 110. Then the wet sheet S pulled out from the pullout port 131*a* is set so as to be pulled out from the sheet dispensing port 113*c* of the main body case 110 (see FIG. 6, FIG. 7, FIG. 8, and FIGS. 10(*a*), (*b*)).

The lid 120 is large enough to cover, from above, the wet sheet S that is present at least in a range from the pullout port 131*a* of the sheet cartridge 130 from which the wet sheet S has been pulled out up to the sheet dispensing port 113*c*. This makes it possible to cover the wet sheet S exposed from the sheet cartridge 130 in the main body case 110 to prevent the wet sheet S in this range from becoming dry. In this embodiment, the lid 120 has a top plate 121 in a substantially rectangular shape whose front side is substantially in an arc shape in a plan view and a peripheral wall 122 extending from the periphery of the top plate 121 toward the opening 115 of the main body case 110 to be joinable to the peripheral edge of the opening 115 of the main body case 110. In the peripheral wall 122 of the lid 120, the vicinity of a lower portion of the front plate 122*a* located on the front side is pivotally supported by and attached to the vicinity of a front end of the upper projecting surface 113*a* of the main body case 110. Therefore, as illustrated in FIG. 3, the lid 120 can be opened/closed around the vicinity of the lower portion of the front plate 122*a* such that it separates more from the peripheral edge of the opening 115 of the main body case 110 as it goes toward the rear plate 122*b* of the peripheral wall 122.

The sheet feeding mechanism 20 includes a driving roller 210, a driven roller 220, and a drive control part 230 and is provided in the casing 10. The driving roller 210 and the driven roller 220 are disposed upstream of the sheet dispensing port 113*c* in terms of the sheet feeding direction of the wet sheet S (close to the pullout port 131*a* of the sheet cartridge 130) and in this embodiment, they are disposed in a region from the pullout port 131*a* of the sheet cartridge 130 up to the sheet dispensing port 113*c* of the main body case 110 (see FIG. 3 to FIG. 8). Further, in this embodiment, the driving roller 210 is rotatably supported between the side surfaces 114, 114 in the main body case 110 at a position slightly above the sheet dispensing port 113*c*. Further, the drive control part 230 which rotates the driving roller 210 is also provided in the main body case 110 in this embodiment. The drive control part 230 has a motor 231 and a control board (not illustrated) which exchanges signals with various sensors (a hand etc. detecting sensor 235 and a feed amount detecting part 236 which will be described later) to control the driving of the motor 231. The drive control part 230 also includes a transmission belt 233 wound between a motor-side pulley 232 which is coupled to an output shaft of the motor 231 and a roller-side pulley 211 which is provided on the driving roller 210, and transmits the rotational force of the motor 231 to the driving roller 210 through these.

Figure 7:
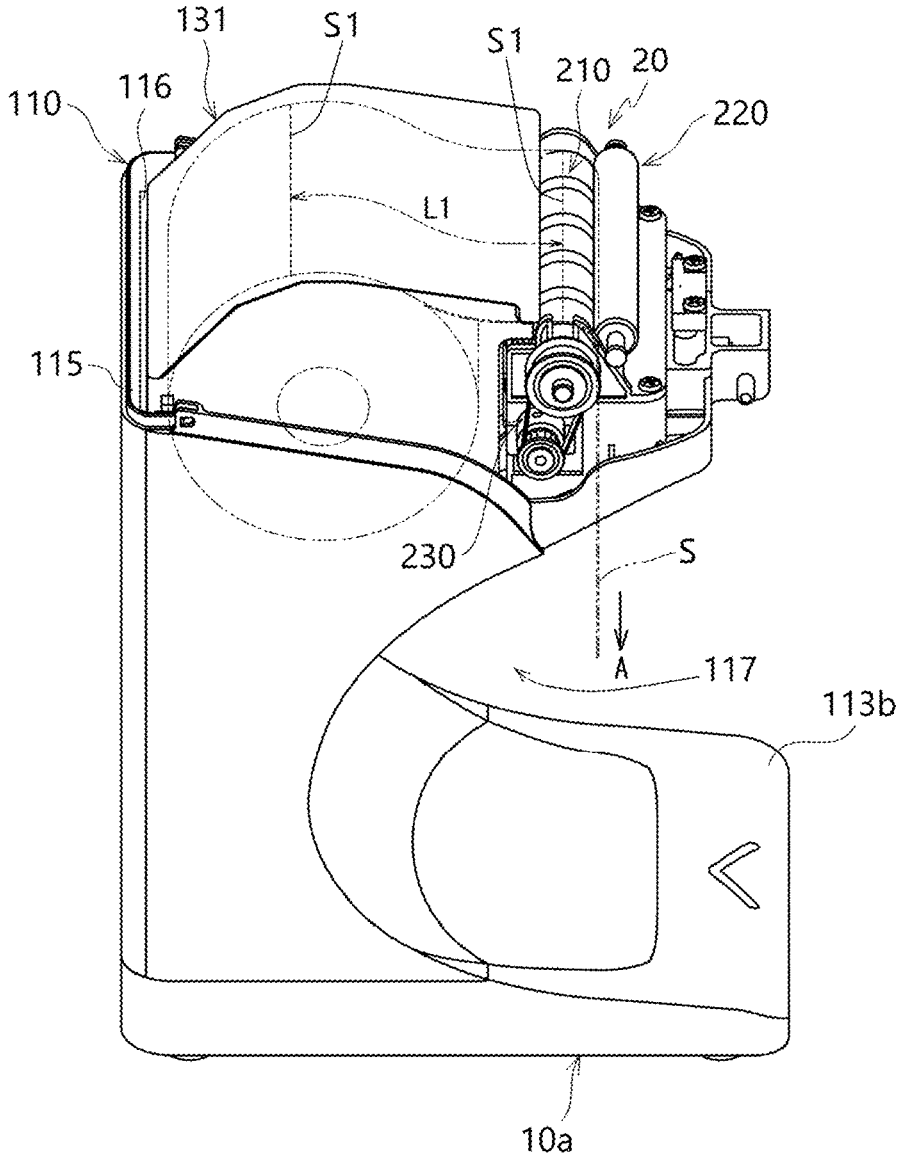
FIG. 7 is a perspective view of the main body case side illustrating a state in which the wet sheet is transferred by the driving roller and a driven roller.

The driven roller 220 rotatably extends along the width direction at a position close to the front plate 122*a* of the peripheral wall 122 of the lid 120. Further, as illustrated in FIG. 7, the driven roller 220 is provided at a position where it faces the driving roller 210 when the lid 120 is closed, and is biased by elastic members in a direction in which it approaches the driving roller 210. Specifically, as illustrated in FIG. 3 and FIG. 4, end portions 221*a*, 221*a* of a rotary shaft 221 of the driven roller 220 are rotatably supported by leaf springs 222, 222 as the elastic members which are provided apart from each other in the width direction near the inner sides of the peripheral wall 122 of the lid 120. The elastic force of the leaf springs 222, 222 is set to act in such a direction as to make the driven roller 220 approach the driving roller 210 when the lid 120 is closed. It should be noted that the elastic members biasing the driven roller 220 in the direction in which the driven roller 220 approaches the driving roller 210 are not limited to these, and other springs such as coil springs, rubber, or the like are adoptable instead of the leaf springs 222, 222.

Figure 8:
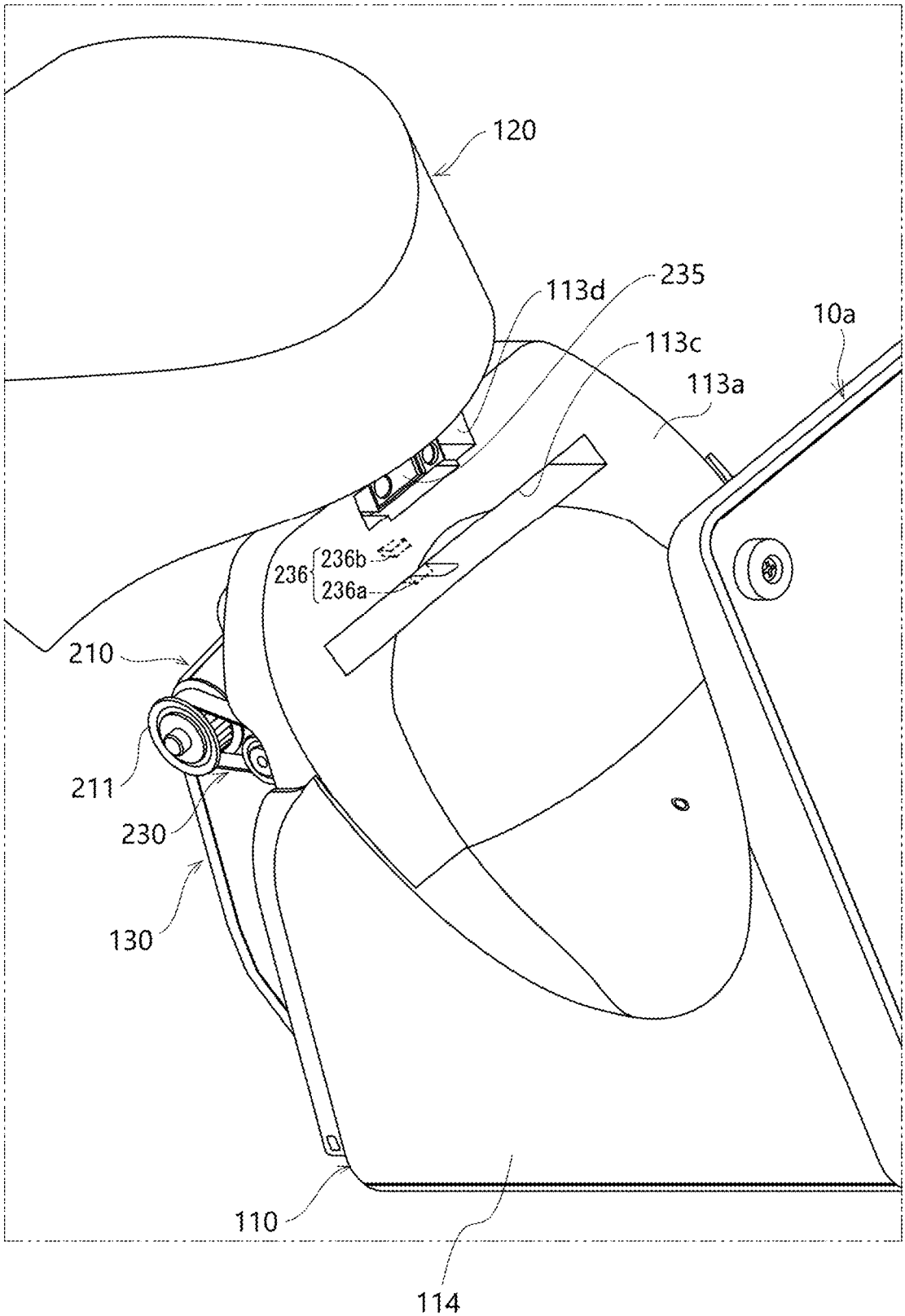
FIG. 8 is a perspective view illustrating an essential part of the sheet dispensing device seen from a sheet dispensing port side.

The drive control part 230 is preferably provided with the hand etc. detecting sensor 235 which is provided at an appropriate place of the casing 10 for the non-contact detection of the approach of some part of the user's body (usually "hand", and therefore will be expressed as "hand etc."). The motor 231 can be controlled to rotate when the hand etc. detecting sensor 235 detects the presence of a hand etc. The hand etc. detecting sensor 235 may be a sensor using light (including infrared rays) or ultrasonic wave and its kind is not limited. Further, the attachment position of the hand etc. detecting sensor 235 is not limited either, but in this embodiment, as illustrated in FIG. 8, the hand etc. detecting sensor 235 constituted by a reflective infrared sensor is provided in a placement hole 113*d* formed in the upper projecting surface 113*a* of the curved front surface 113 to be capable of detecting that a hand etc. is inserted to the front-side space 117 located under the sheet dispensing port 113*c*. As another possible configuration example, the hand etc. detecting sensor 235 is provided on the top plate 121 or the peripheral wall 122 of the lid 120, the side surfaces 114, 114 of the main body case 110, or any other place, and detects a hand etc. not when the hand etc. is inserted to the front-side space 117 located under the sheet dispensing port 113*c* but when the hand etc. is put over an outer side of the hand etc. detecting sensor 235 provided on the top plate 121 of the lid 120 or the other place.

Figure 6:
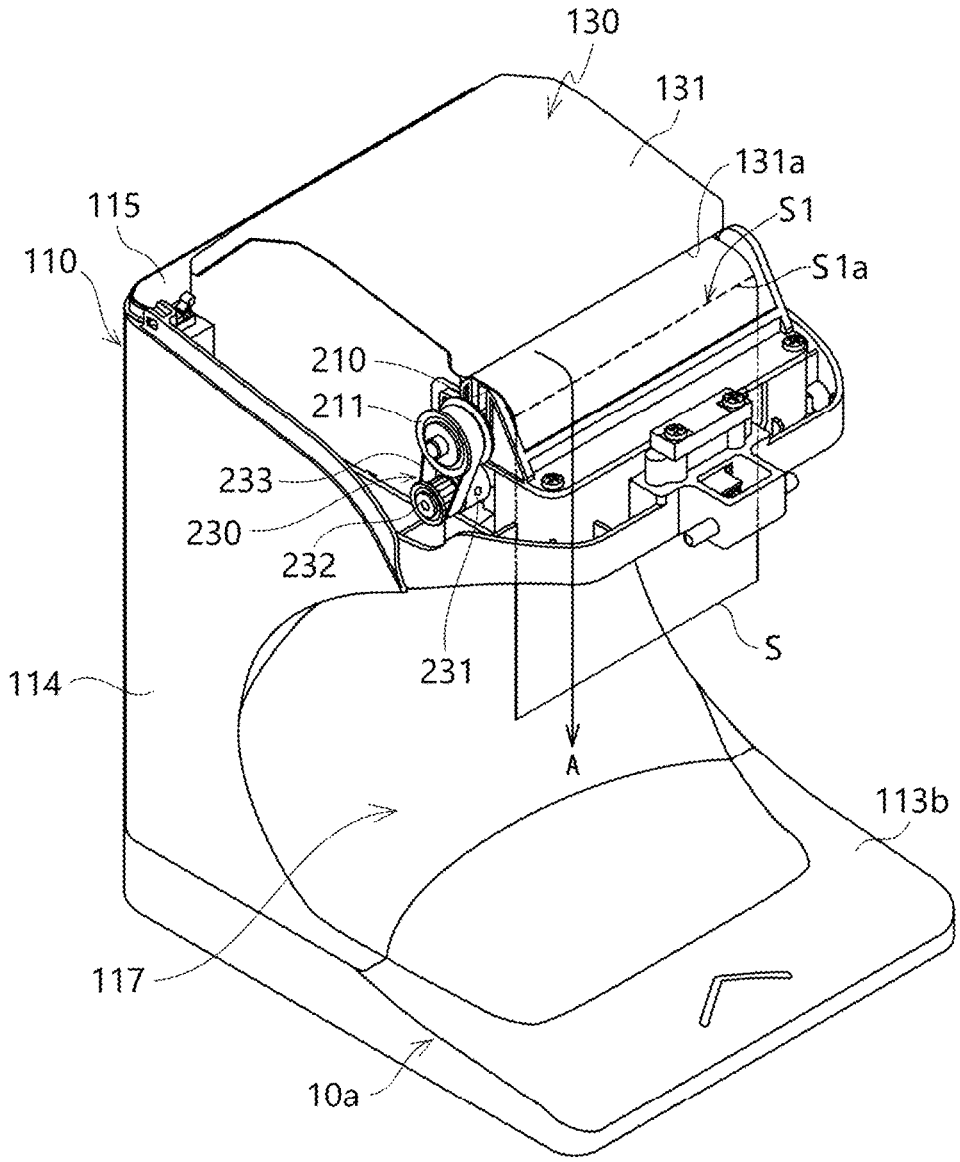
FIG. 6 is a perspective view of the main body case side including a wet sheet transferred from a sheet cartridge beyond the driving roller.

The drive control part 230 preferably has the feed amount detecting part 236 for controlling an amount of the wet sheet S fed per time. The drive control part 230 can automatically stop driving the motor 231 when receiving, from the feed amount detecting part 236, a signal indicating that a predetermined feed amount is reached after it starts driving the rotation of the motor 231 in response to the detection of the presence of a hand etc. by the hand etc. detecting sensor 235. The feed amount detecting part 236 can be, for example, a timer that detects the driving time, a sensor that measures the feed length of the wet sheet S, a sensor that detects a rotation amount of the driving roller 210 or the driven roller 220, or the like, and as illustrated in FIG. 6 and FIG. 7, this embodiment uses, as the wet sheet S, one in which cutting lines (perforations (in which slits S1*a* of small holes or long holes are continuously formed in the width direction of the wet sheet S in a dotted line form or a broken line from)) S1 are made at predetermined intervals in the feeding direction (arrow A direction indicated in FIG. 6 and FIG. 7), and uses a sensor that detects the cutting line S1.

Figure 9:
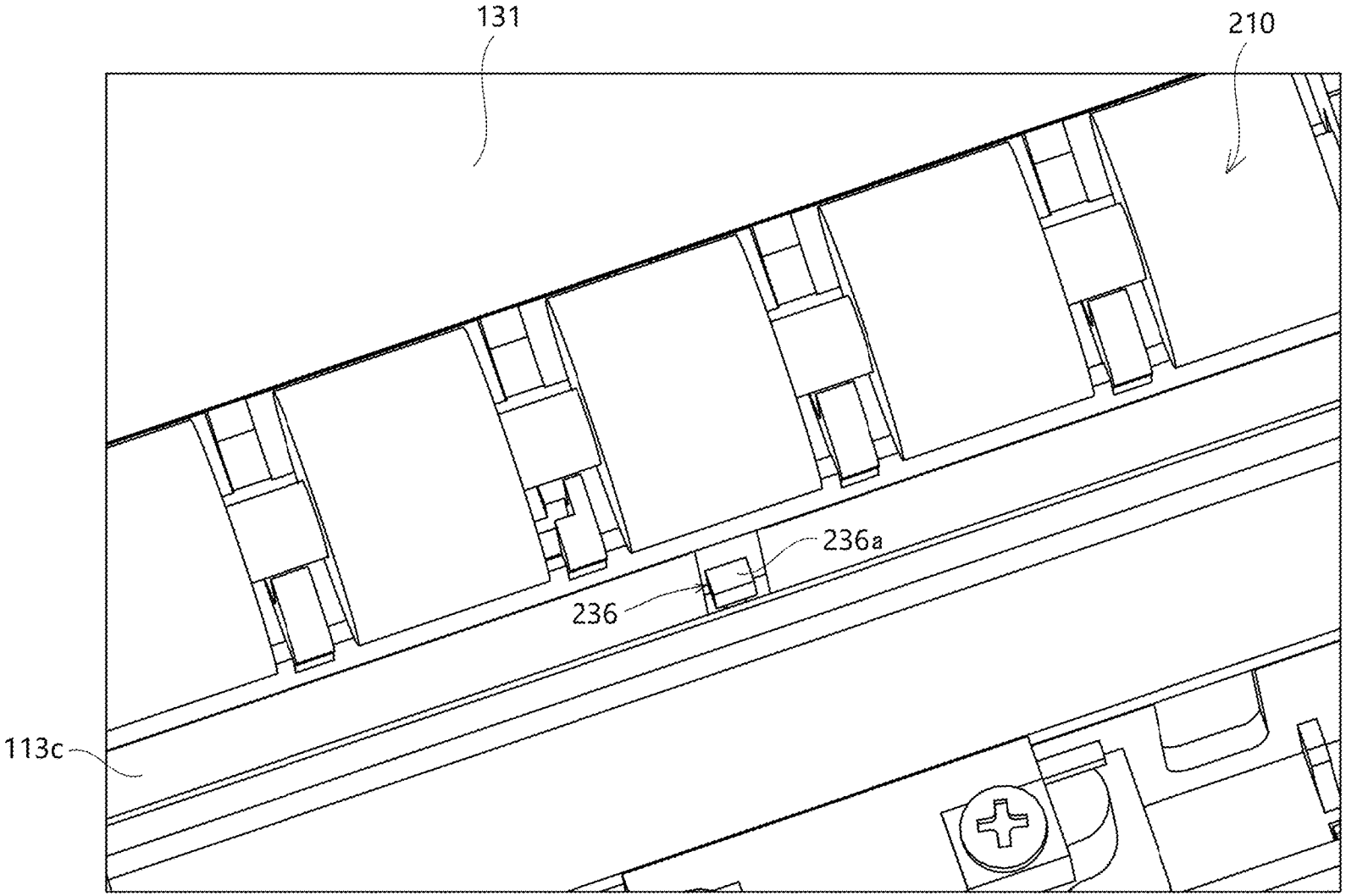
FIG. 9 is an explanatory view of the structure of a feed amount detecting part.

The kind of the sensor constituting the feed amount detecting part 236 that detects the cutting line S1 is not limited, but this embodiment uses an optical sensor (including an infrared sensor). Its attachment position is not limited, and in this embodiment, as illustrated in FIG. 8 and FIG. 9, it is provided slightly deviated from the arrangement position of the driving roller 210 and the driven roller 220 toward the sheet dispensing port 113*c*. Further, the feed amount detecting part 236 includes a light emitting part 236*a* and a light receiving part 236*b*, which face each other and sandwich the wet sheet S passing between the driving roller 210 and the driven roller 220 (see FIG. 8 and FIG. 9). The number of the optical sensors disposed is not limited and may be one or plural. Arranging the plurality of optical sensors along the feeding direction of the wet sheet S makes it possible to more surely detect the cutting line S1 even if the wet sheet S is fed slightly obliquely. Further, this enables such setting that, when the plurality of optical sensors detect a set of the through holes of the cutting line S1 and the surface, of the wet sheet S, located in front of and in the rear of the through holes of the cutting line S1, it is determined that the cutting line S1 is detected, enabling higher detection accuracy as compared with the setting of detecting only the through holes of the cutting line S1.

Next, the operation of the sheet dispensing device 1 according to this embodiment will be described. First, the lid 120 is opened, and the sheet cartridge 130 is placed on the sheet placement part 116 in the main body case 110 see FIG. 3). Next, the wet sheet S is pulled out from the pullout port 131*a*, its leading edge is passed above the outer peripheral surface of the driving roller 210 to be wound therearound, and the wet sheet S is set with its leading edge located near the sheet dispensing port 113*c* (see FIG. 6). Next, when the lid 120 is closed, the driven roller 220 faces the driving roller 210 with the wet sheet S therebetween (see FIG. 7). Being biased by the leaf springs 222, 222, the driven roller 220 is pressed toward the driving roller 210 with the wet sheet S therebetween. Note that the drive control part 230 is set to stop the motor 231 when the optical sensor constituting the feed amount detecting part 236 detects the first cutting line S1 after the drive control part 230 drives the motor 231 in response to a detection signal received from the hand etc. detecting sensor 235

Figure 2:
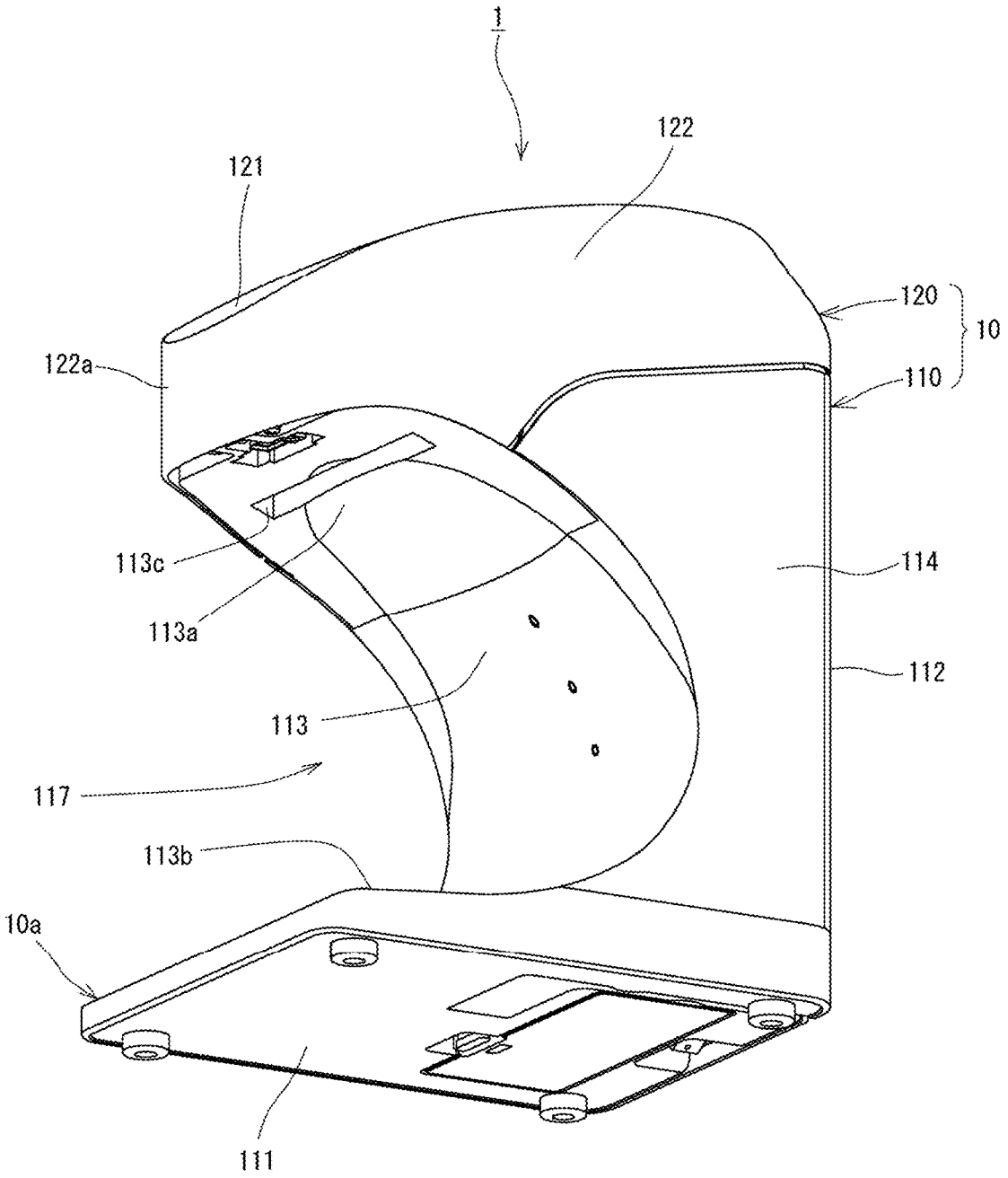
FIG. 2 is a perspective view illustrating the outer appearance of the sheet dispensing device in FIG. 1 seen from a front lower direction.

FIG. 1 and FIG. 2 illustrate the outer appearance in the state set as above, and in this state, the wet sheet S is not present in the front-side space 117. In this embodiment, when the user inserts his/her hand etc. to the front-side space 117 in this state, the hand etc. detecting sensor 235 detects the hand etc. Its detection signal is sent to the drive control part 230, and the drive control part 230 drives the motor 231. Consequently, the driving roller 210 rotates, and accordingly the driven roller 220 rotates. As a result, the wet sheet S sandwiched between the driving roller 210 and the driven roller 220 is drawn from the sheet dispensing port 113*c* to the outside, that is, to the front-side space 117. When a predetermined amount of the wet sheet S is transferred, the optical sensor constituting the feed amount detecting part 236 detects the next cutting line S1, and its detection signal is transmitted to the drive control part 230. Upon receiving the detection signal, the drive control part 230 stops driving the rotation of the motor 231.

Figure 10:
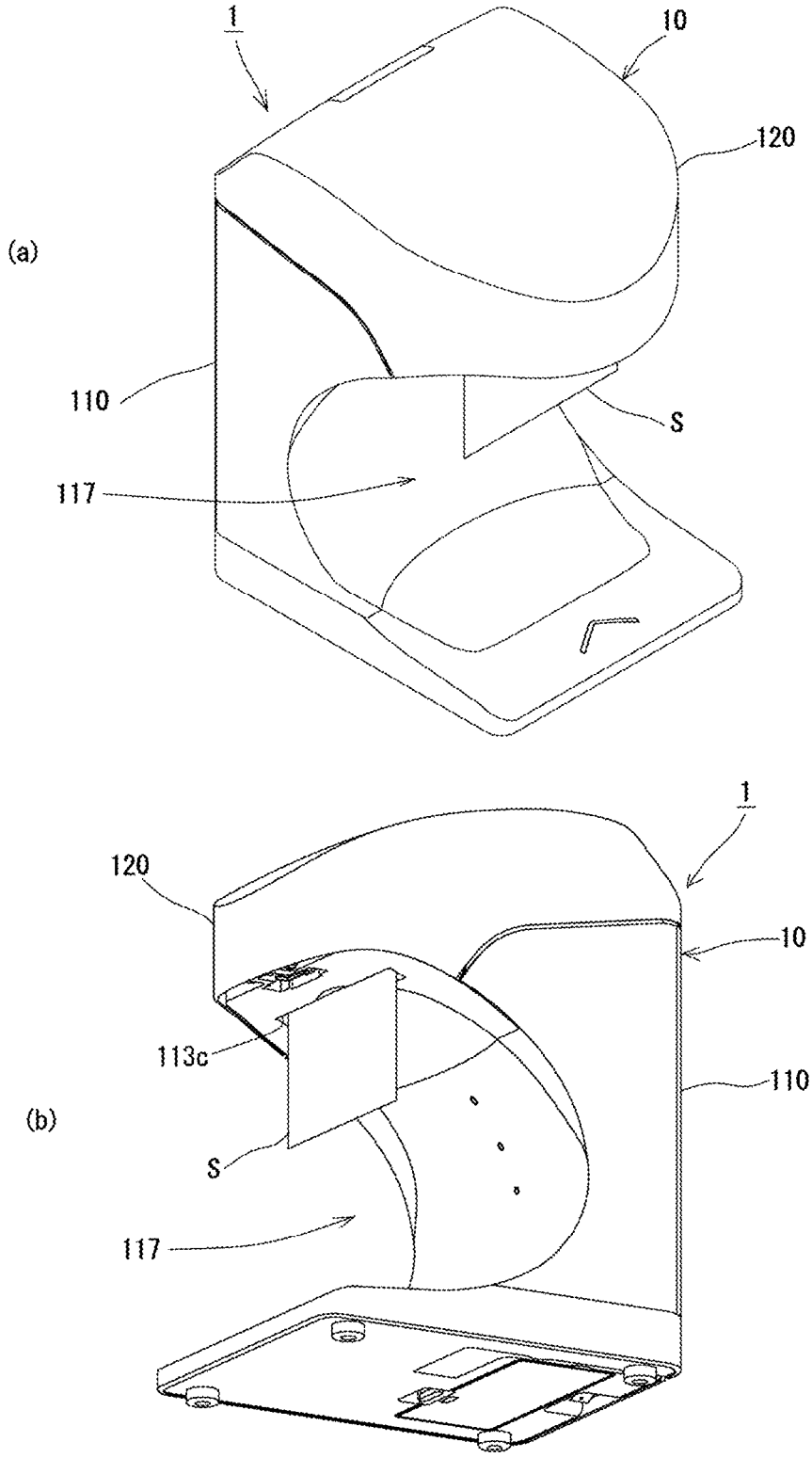
FIG. 10(*a*) is an explanatory perspective view, seen from a front upper direction, of the operation of the sheet dispensing device of the embodiment.

Consequently, the wet sheet S stays while its predetermined length hangs down from the sheet dispensing port 113*c* as illustrated in FIGS. 10(*a*), (*b*). Specifically, based on a certain cutting line S1 that stays at the attachment position of the feed amount detecting part 236, the wet sheet S stays while its part corresponding to a length between two cutting lines S1, S1 (length corresponding to L1 indicated in FIG. 7) formed in the wet sheet S adjacently in the feeding direction (the arrow A direction in FIG. 6 and FIG. 7) hangs down. The user holds and pulls down the hanging wet sheet S. Consequently, the wet sheet S is cut apart along the cutting line S1 located near the sheet dispensing port 113*c* because it is sandwiched between the driving roller 210 and the driven roller 220 with a predetermined pressing force at the position upstream of the sheet dispensing port 113*c* in terms of the sheet feeding direction A, that is, at the position slightly deviated from the position of the sheet dispensing port 113*c* toward the pullout port 131*a* of the sheet cartridge 130. This enables the user to take the predetermined length of the wet sheet S without touching any part other than the wet sheet S, to wipe his/her hands etc.

In the above-described embodiment, the rolled wet sheet S is provided in the stored state in the sheet cartridge 130 (see FIG. 7). However, the main body case 110 is structured such that its opening 115 is closed with the lid 120 and the driven roller 220 is disposed upstream of the sheet dispensing port 113*c* in terms of the sheet feeding direction A of the wet sheet S while constantly biased in the direction in which it approaches the driving roller 210 as described above. Therefore, slightly above the sheet dispensing port 113*c*, the driving roller 210 and the driven roller 220 whose outer peripheral surfaces approach each other nearly close a feed path of the wet sheet S, so that the casing 10 itself of this embodiment has a relatively highly airtight structure. Therefore, according to the casing 10 of this embodiment, even if the rolled wet sheet S is set on the sheet placement part 116 to be used without being stored in the sheet cartridge 130, it can be used without becoming dry for some time. Therefore, depending on the frequency of use of the wet sheet S, the wet sheet S may be disposed in the casing 10 without being stored in the sheet cartridge 130, and this enables cost reduction. Of course, the wet sheet S stored in the sheet cartridge 130 is preferable because it is less likely to become dry, and also is more superior from a hygienic viewpoint.

Further, in the above-described embodiment, the length of the wet sheet S fed per time is set to the single length L1 between the adjacent cutting lines S1, S1, but can, of course, be set to a plurality of lengths L1. However, since the length fed per time almost corresponds to the length of the wet sheet S hanging down from the sheet dispensing port 113*c*, the length fed per time is set shorter than the up-down direction height of the front-side space 117, that is, shorter than the height from the lower projecting surface 113*b* constituting the base 10*a* up to the sheet dispensing port 113*c*, and is set within such a range that the hanging wet sheet S does not come into contact with the lower projecting surface 113*b*.

Figure 11:
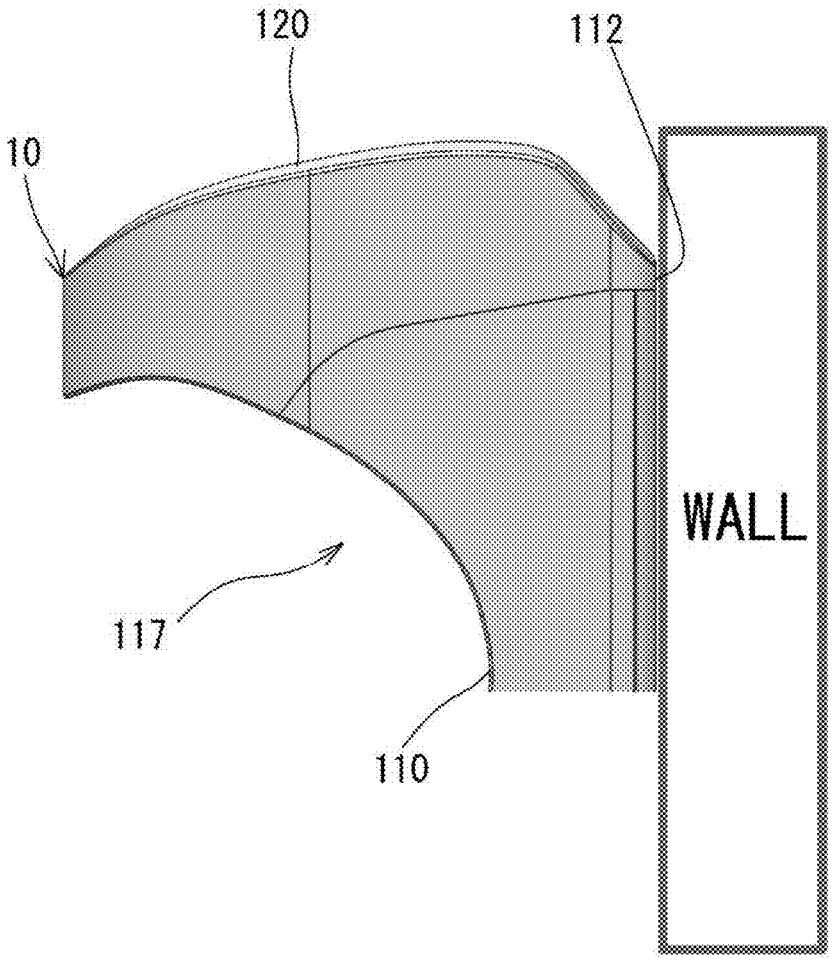
FIG. 11 is a view illustrating an example of a sheet dispensing device of a type attached to a wall.

On the other hand, the structure illustrated in FIG. 11 in which the rear surface 112 of the main body case 110 is attachable to a wall can eliminate a need for the base 10*a*. Without any member defining the lower side of the front-side space 117, this structure allows setting the length of the wet sheet S fed per time longer than the aforesaid length. Further, such a structure not requiring the base 10*a* can reduce the manufacturing cost of the cost of the sheet dispensing device 1.

Further, as the wet sheet S, one in which the cutting lines S1 are formed is used. However, in this embodiment, upstream of the sheet dispensing port 113*c* in terms of the sheet feeding direction A, the wet sheet S is sandwiched between the driving roller 210 and the driven roller 220 with the predetermined elastic force that biases the driven roller 220. Therefore, even without the cutting lines S1, if the wet sheet S hangs down from the sheet dispensing port 113*c*, pulling the hanging portion results in that the wet sheet S is cut between the position where it is sandwiched by the driving roller 210 and the driven roller 220 and the vicinity of the sheet dispensing port 113*c*, making it possible to dispense the wet sheet S. Needless to say, the wet sheet S having the cutting lines S1 can be cut more quickly with its cut edge being substantially straight and thus is more preferable. Further, in the case where the wet sheet S not provided with the cutting lines S1 is used, it is possible to control the feed length by using, as the feed amount detecting part 236, the timer that detects the driving time, the sensor that measures the feed length of the wet sheet S, the sensor that detects the rotation amount of the driving roller 210 or the driven roller 220, or the like as described above.

Even in the case where the cutting lines S1 are not provided, not to mention the case where the cutting lines S1 are provided, since the wet sheet S is wet, only by sandwiching the wet sheet S by the driving roller 210 and the driven roller 220 with the predetermined elastic force, it is possible to cut apart the wet sheet S hanging down from the sheet dispensing port 113*c* only by pulling it even if a cutting mechanism such as a cutter is not provided. Therefore, the sheet dispensing device 1 of this embodiment is suitable especially for dispensing the wet sheet S. Further, since a cutter or the like is not necessary, safer maintenance work or the like is possible.

Figure 12:
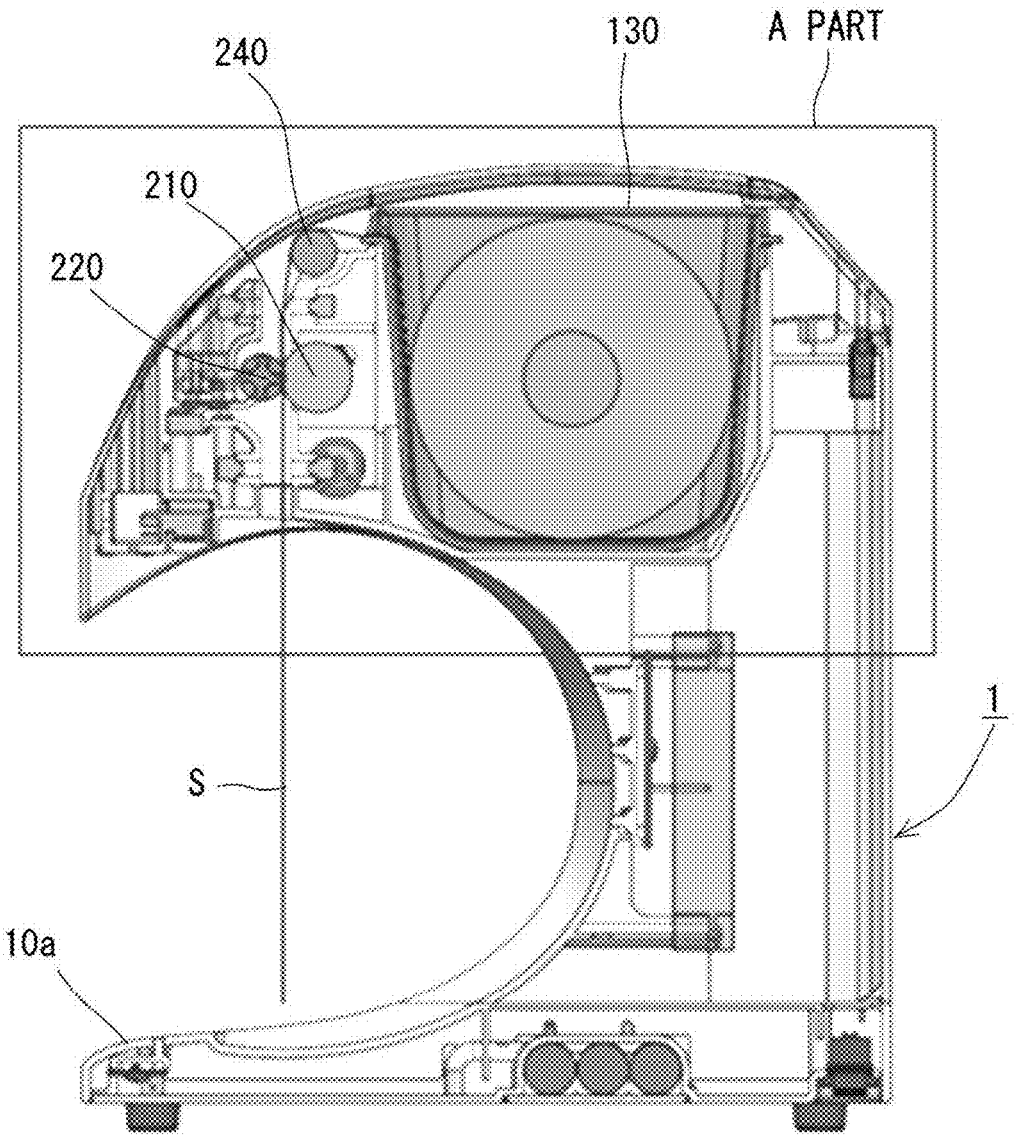
FIG. 12 is a side view illustrating an internal mechanism of a sheet dispensing device according to another embodiment of the present invention.
Figure 13:
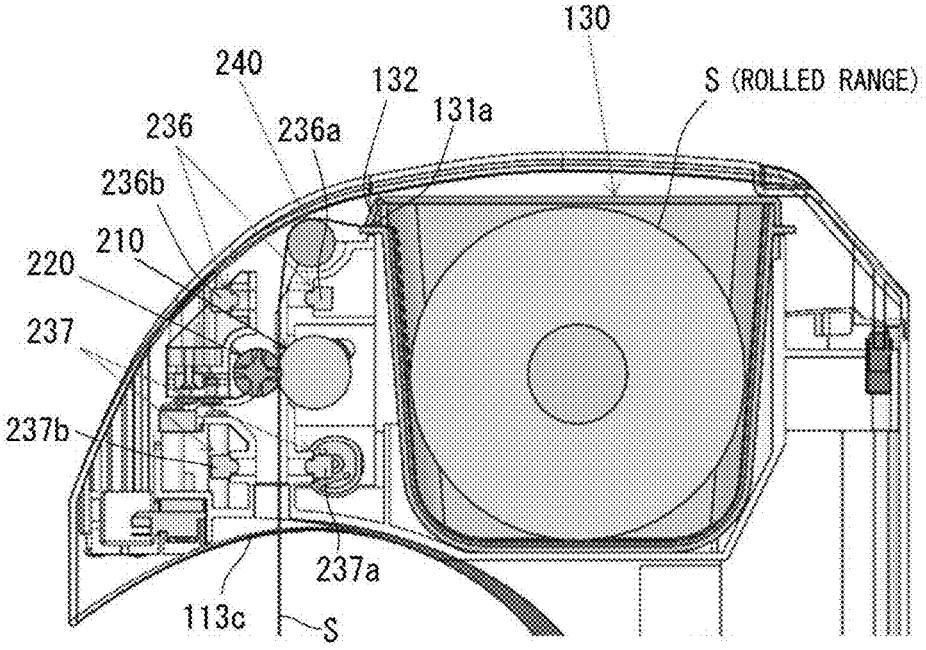
FIG. 13(*a*) is an enlarged view of A part in FIG. 12.
Figure 13:
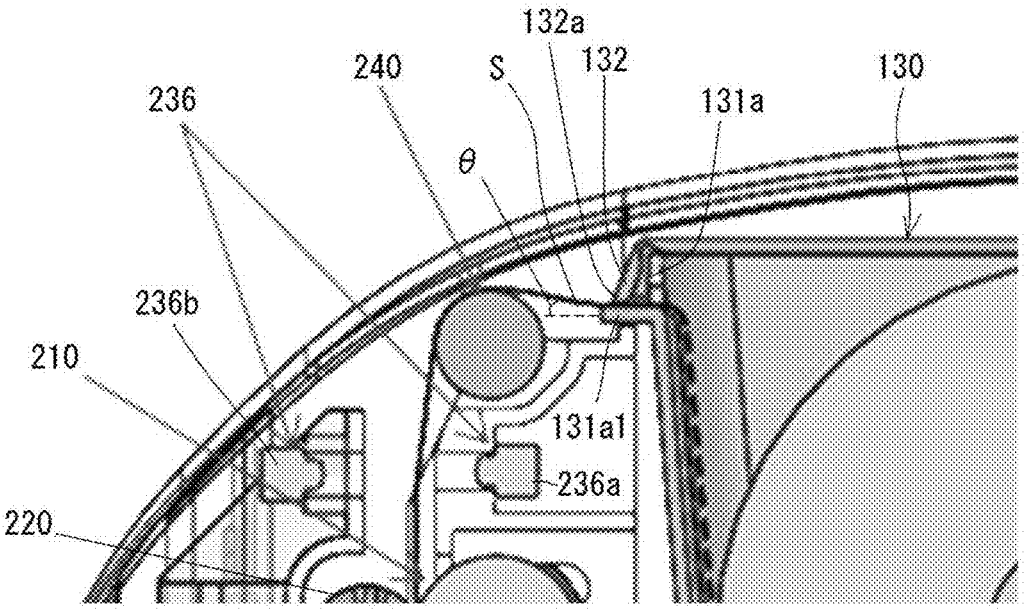
Figure 14:
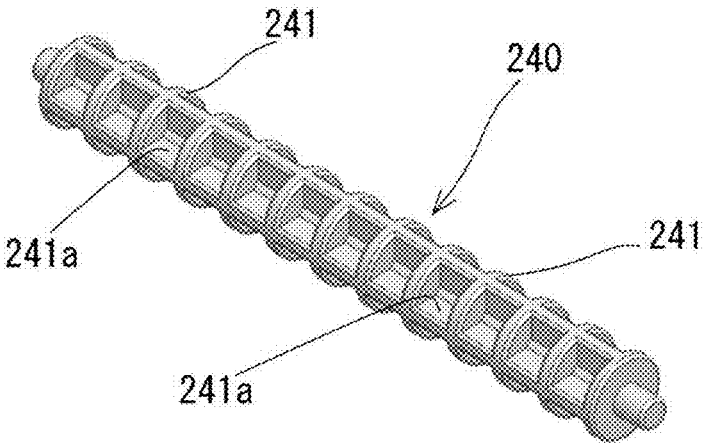
FIG. 14(*a*) is a perspective view illustrating the fracture preventing auxiliary roller used in the sheet dispensing device of the other embodiment.
Figure 14:
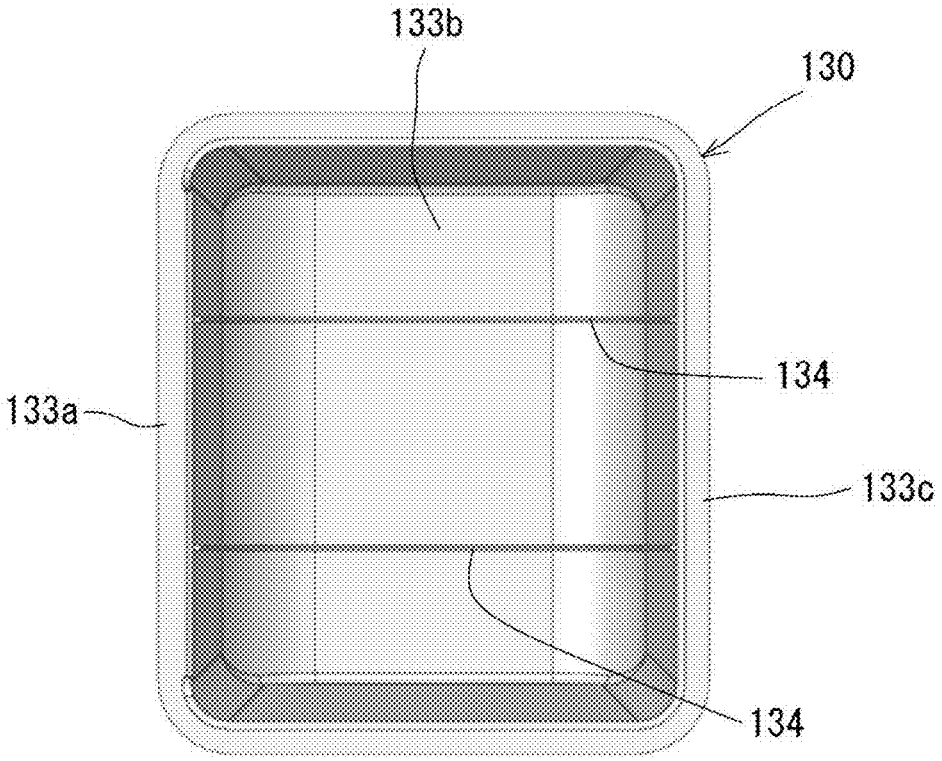

FIG. 12 to FIG. 14 are views illustrating another embodiment of the present invention. This embodiment includes a resistance applying part that applies a predetermined resistance when a rolled sheet S stored in a sheet cartridge 130 placed on a sheet placement part 116 is fed out. When a feed amount detecting part 236 including a light emitting part 236*a* and a light receiving part 236*b* detects slits S1*a* (see FIG. 6) forming a cutting line S1 of the rolled sheet S, a driving roller 210 is rotated to draw out a predetermined length of the rolled sheet S as described in the above embodiment, but if the slits S1*a* are scarcely open when the cutting line S1 passes between the light emitting part 236*a* and the light receiving part 236*b*, the cutting line S1 does not transmit light and it may not be possible to detect the cutting line S1. Therefore, in this embodiment, the resistance applying part that applies a force of pulling the sheet S along the feeding direction is provided to ensure that the slits S1*a* of the cutting line S1 are open when the cutting line S1 passes between the light emitting part 236*a* and the light receiving part 236*b*.

In this embodiment, an elastic contact piece 132 is provided at a pullout port 131*a* of a sheet cartridge 130 to cover the pullout port 131*a*, and this elastic contact piece 132 is the resistance applying part. The elastic contact piece 132 is integrally formed on an upper edge portion of a cover 131 and hangs down, and its lower edge portion 132*a* is movable in a direction in which it separates from the pullout port 131*a* outward, while the lower edge portion 132*a* is unmovable more inward than the pullout port 131*a*, that is, toward the inside of the sheet cartridge 130 because it comes into contact with a lower frame portion 131*a*1 of the pullout port 131*a*. Further, when the lower edge portion 132*a* moves away outward, the elastic force acts in such a direction that the elastic contact piece 132 closes the pullout port 131*a*. Therefore, when the sheet S is pulled to a gap between the lower edge portion 132*a* of the elastic contact piece 132 and the lower frame portion 131*a*1 of the pullout port 131*a*, the elastic contact piece 132 presses the surface of the sheet S. Therefore, the elastic force of the elastic contact piece 132 works as the resistance in the feeding direction. The elastic contact piece 132 may be any as long as it can thus press the sheet S, and may be a spring member made of synthetic resin, metal, or the like that is separate from the sheet cartridge 130.

Being constantly biased in the direction in which it comes into contact with the lower frame portion 131*a*1 of the pullout port 131*a*, the elastic contact piece 132 constantly tries to close the pullout port 131*a* and thus also has a function of increasing a moisture retaining property in the sheet cartridge 130.

Further, in this embodiment, the driving roller 210 and the driven roller 220 are provided at a position that is closer to the sheet dispensing port 113*c* than in the above-described embodiment and is lower than the height of the pullout port 131*a* of the sheet cartridge 130. Therefore, when the sheet S pulled out from the pullout port 131*a* is directly pulled by the driving roller 210 and the driven roller 220, there is a possibility that the sheet S fractures from the cutting line S1 before discharged from the sheet dispensing port 113*c*. This possibility increases especially in the configuration in which the elastic contact piece 132 is provided and applies the resistance to open the slits S1*a* of the cutting line S1 when the sheet is fed as in this embodiment. Therefore, in such a case, a fracture preventing auxiliary roller 240 that receives the sheet S pulled out from the pullout port 131*a*, at a position closer to the pullout port 131*a* than the driving roller 210 and the driven roller 220 is preferably disposed in the casing 10. The fracture preventing auxiliary roller 240 is preferably disposed at such a position as to make the sheet S pulled out from the pullout port 131*a* take a posture extending substantially horizontally, that is, at such a position that a peripheral surface 241 of the fracture preventing auxiliary roller 240 is located at substantially the same height as the pullout port 131*a*. The substantially horizontally extending posture of the sheet S is intended not to apply a further resistance to the sheet S that is pulled out while receiving the resistance of the elastic contact piece 132, and in the side view in FIGS. 13(*a*), (*b*), "substantially horizontally" includes a range up to an about plus/minus 20 degrees upward and downward relative to the horizontal direction extending from the position between the lower edge portion 132*a* of the elastic contact piece 132 and the lower frame portion 131*a*1 of the pullout port 131*a*. More preferably, the fracture preventing auxiliary roller 240 is provided such that the sheet S takes a posture inclined upward from the horizontal direction by an angle θ of about 2 to 12 degrees.

Preferably, as illustrated in FIG. 14(*a*), the fracture preventing auxiliary roller 240 has a plurality of dents 241*a* on its peripheral surface 241 around which the sheet S is wound so that its contact area with the sheet S is as small as possible. As the contact area of the peripheral surface 241 of the fracture preventing auxiliary roller 240 and the sheet S is smaller, the sheet S is less easily stuck, and the effect of preventing the fracture from the cutting line S1 during the feeding is higher.

When the sheet S is fed out, in the sheet cartridge 130, a rolled part of the sheet S rotates. A large resistance at the time of this rotation leads to an increased possibility of a fracture of a certain one of the cutting lines S1 due to the pulling force of the driving roller 210. Therefore, in the sheet cartridge 130, a rotation assisting means is preferably provided to make the rotation of the rolled sheet smooth. In this embodiment, as illustrated in FIG. 14(*b*), the rotation assisting means is constituted by one rib 134 or more formed to project on a front surface 133*a*, a bottom surface 133*b*, and a rear surface 133*c* and extend along the rotation direction of the rolled sheet S. The rotation assisting means is not limited to this, and can be constituted by a rotating roller (not illustrated) provided on the bottom surface 133*b* or the like.

In the embodiment illustrated in FIG. 1 to FIG. 10, the feed amount detecting part 236 including the light emitting part 236*a* and the light receiving part 236*b* is provided at a position deviated from the arrangement position of the driving roller 210 and the driven roller 220 toward the sheet dispensing port 113*c*, but in this embodiment, as illustrated in FIGS. 13(*a*), (*b*), it is provided at a position that is deviated from the driving roller 210 and the driven roller 220 toward the sheet placement part 116 (the sheet cartridge 130) and is between the driving roller 210/driven roller 220 and the fracture preventing auxiliary roller 240. In the case where a predetermined amount of the sheet S is fed out each time when the feed amount detecting part 236 detects the cutting line S1, the feed amount detecting part 236 may be provided at either of the aforesaid positions, but in this embodiment, as illustrated in FIG. 13(*a*), a sheet detecting sensor 237 is further provided closer to the sheet dispensing port 113*c* beyond the driving roller 210 and the driven roller 220. The sheet detecting sensor 237 also includes a light emitting part 237*a* and a light receiving part 237*b*, and light being blocked means that the sheet S is present between them and the operation is normal. On the other hand, for example, if the feed amount detecting part 236 detects the cutting line S1 but the sheet S is thereafter cut or is not fed and the sheet detecting sensor 237 does not detect the presence of the sheet S, this situation can be notified by error display or the like.

The sheet dispensing device 1 of the above-described embodiments is suitable especially for dispensing the wet sheet S as described above, but is capable of dispensing a non-wet sheet as well if the non-wet sheet is set instead of the aforesaid wet sheet S. However, it is more difficult to cut the non-wet sheet only by pulling it than the wet sheet S, or even if it is cut, its cut edge bends greatly, and therefore the cutting lines S1 are preferably provided in the non-wet sheet at predetermined intervals.

Figure 15:
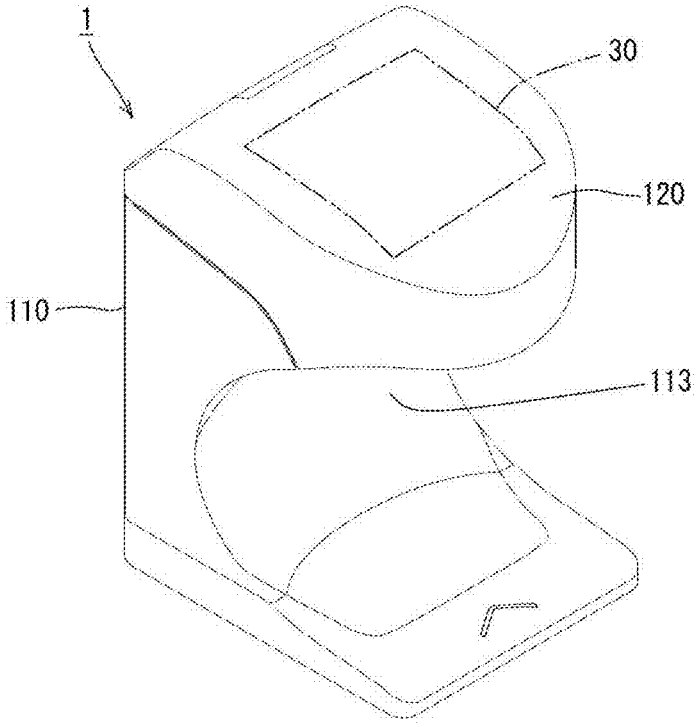
FIG. 15(*a*) is a view illustrating an example in which an information display part is provided on the lid.
Figure 15:
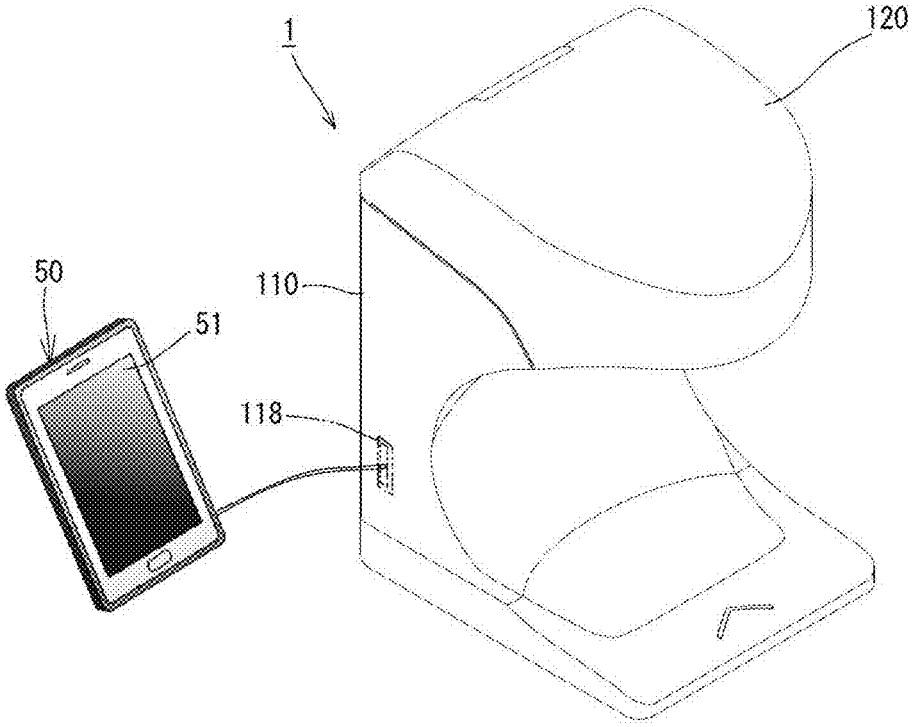

Further, as illustrated in FIG. 15(*a*), an information display part 30 can be provided on, for example, the top plate 121 of the lid 120, the curved front surface 113 of the main body case 110, or the like of the casing 10. The information display part 30 can be constituted by a liquid crystal display, a plurality of LEDs, or the like, and can be configured to display an advertisement of a company that installs the sheet dispensing device 1 or display news, a general weather condition, and so on, constantly or every predetermined time. Further, in a case where the sheet dispensing device 1 is installed in a restaurant, a taxi, or the like, the information display part 30 can display a charge amount (total payment amount, evenly divided amount, or the like) or display a coupon. Further, it can also be used as a display screen of not only a still image but also a moving image, or a video game such as fortune telling. Of course, the information display part 30 can display an error message or the like of the sheet dispensing device 1, or when a remaining amount of the wet sheet S reaches a predetermined amount or less, the information display part 30 can display this information. It is naturally possible to incorporate a communication circuit that, when the remaining amount of the wet sheet S reaches a predetermined amount or less, automatically transmits this information to a maintenance company.

Further, as illustrated in FIG. 15(*b*), the sheet dispensing device 1 can include an interface 118 allowing the wired or wireless connection of a mobile terminal (smartphone, tablet PC, or the like) including an information display part. This makes it possible to display the aforesaid advertisement information, charge amount information, coupon information, and so forth on a display screen 51 of a mobile terminal 50 that a user has. Providing the sheet dispensing device 1 with the information display part 30 such as a liquid crystal display leads to a cost increase of the sheet dispensing device 1, but the use of the mobile terminal 50 that the user has achieves the same effect as in the case where the information display part 30 is provided in the sheet dispensing device 1 itself, while reducing an increase in the manufacturing cost of the sheet dispensing device 1. Further, the wired or wireless connection of the mobile terminal 50 to the sheet dispensing device 1 is advantageous to the user because the user can charge the mobile terminal 50 at the same time.

Further, adding a function of a temperature adjusting mechanism or the like makes it possible to dispense not only a room-temperature sheet but also a warm sheet as the wet sheet S.

Figure 16:
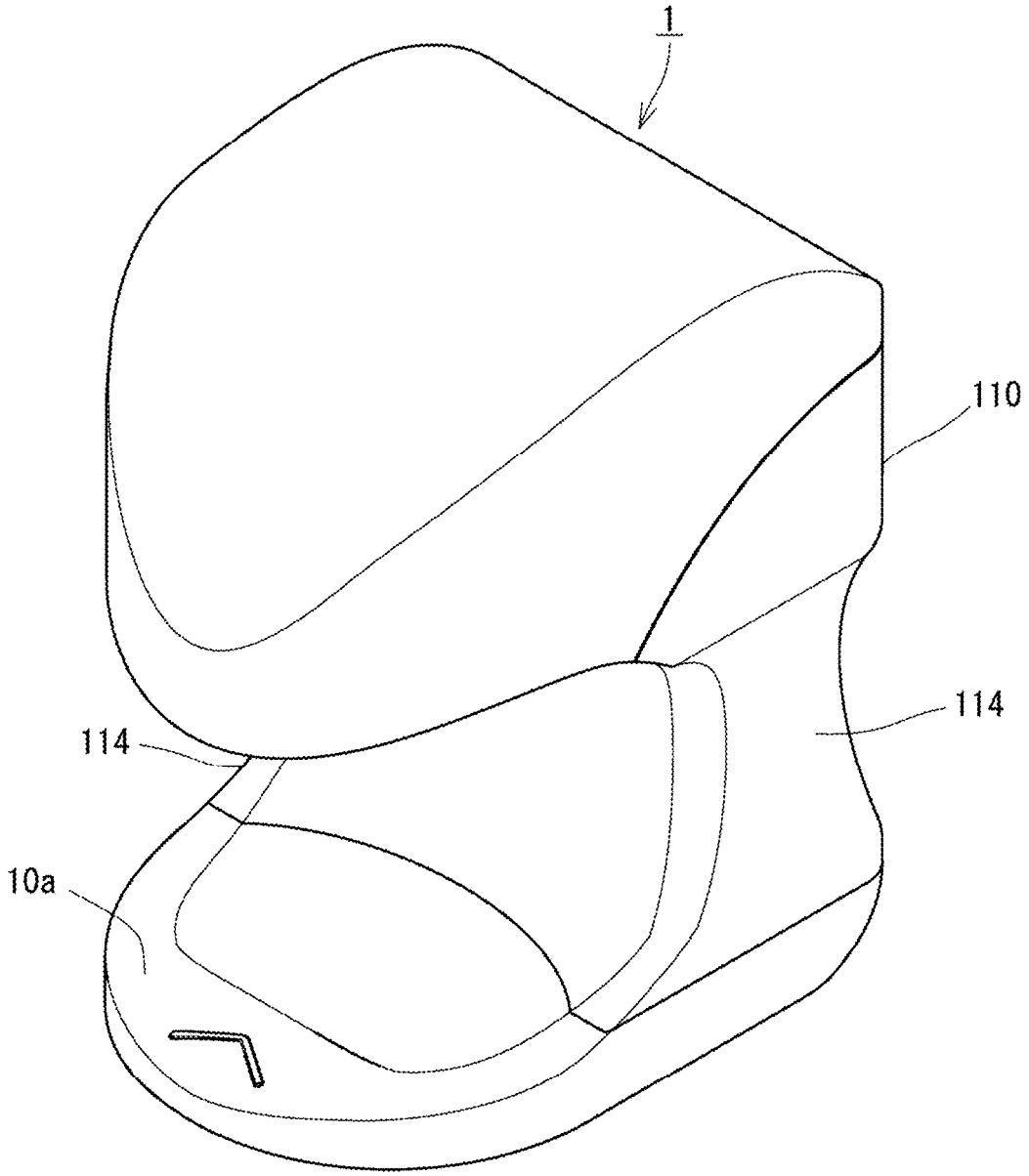
FIG. 16 is a perspective view illustrating a modification example of the outer shape of the sheet dispensing device.
Figure 17:
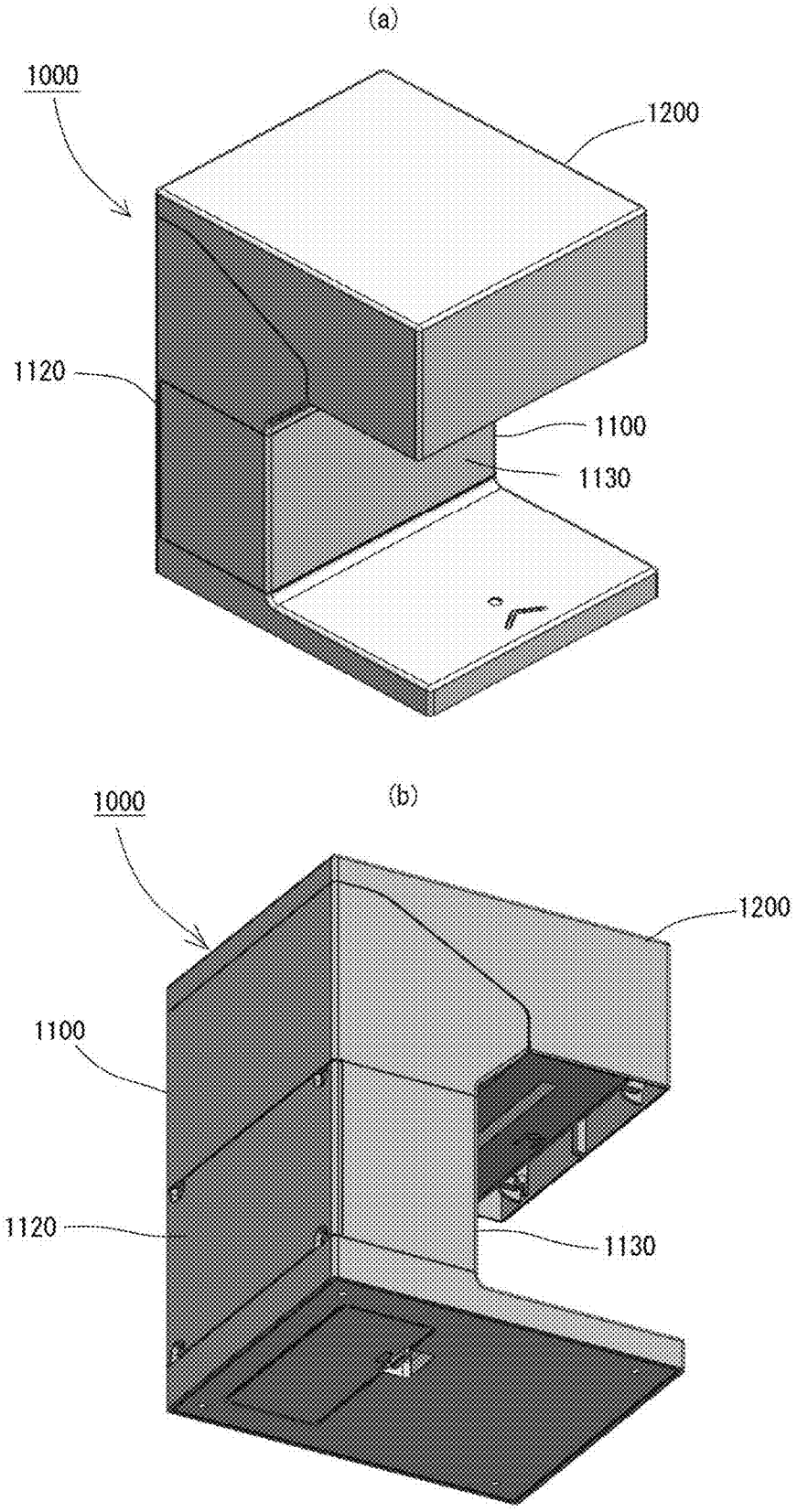
FIG. 17(*a*) is a perspective view illustrating the outer appearance of a sheet dispensing device according to still another embodiment of the present invention seen from a front upper direction.
Figure 18:
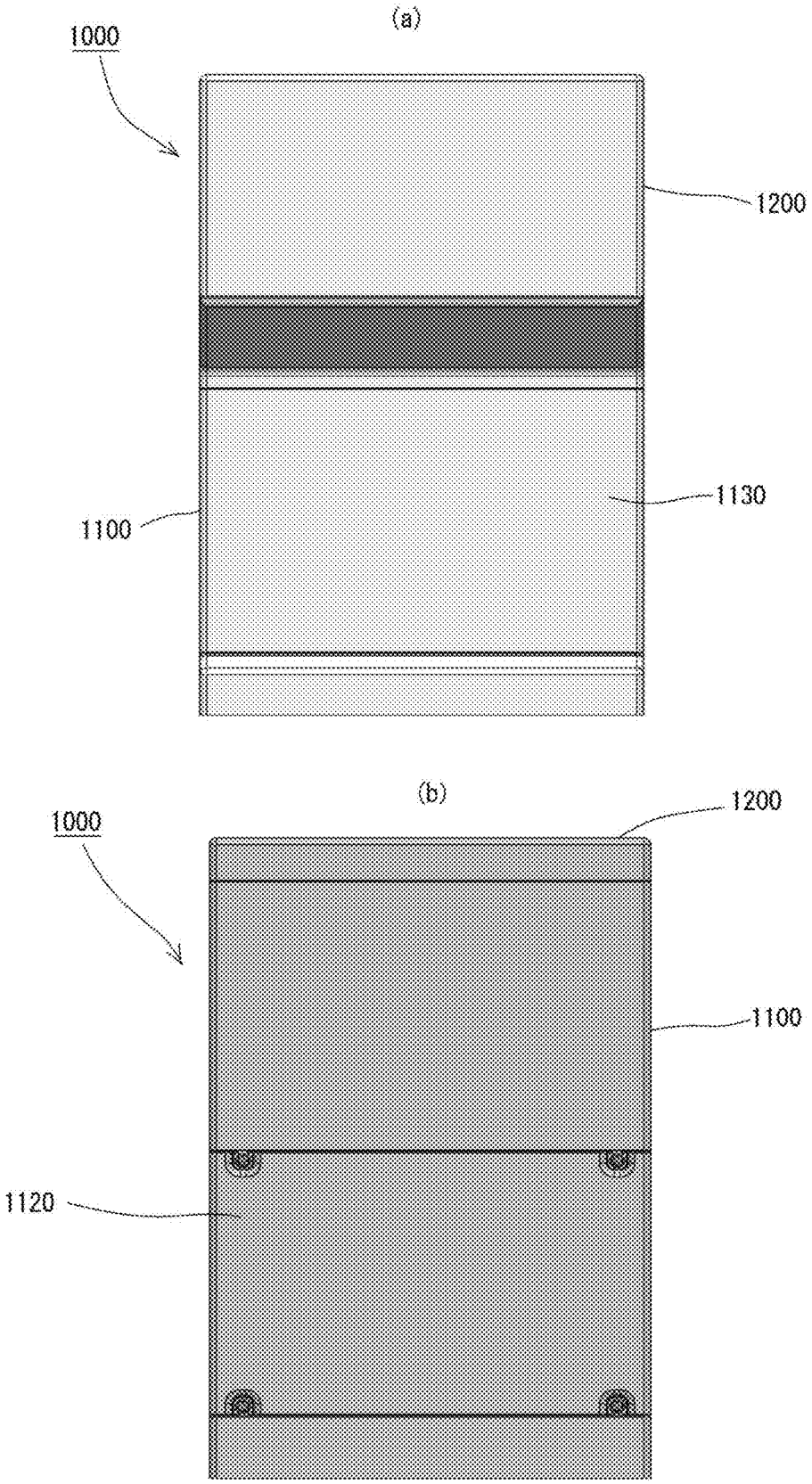
FIG. 18(*a*) is a front view of the sheet dispensing device according to the still another embodiment.
Figure 19:
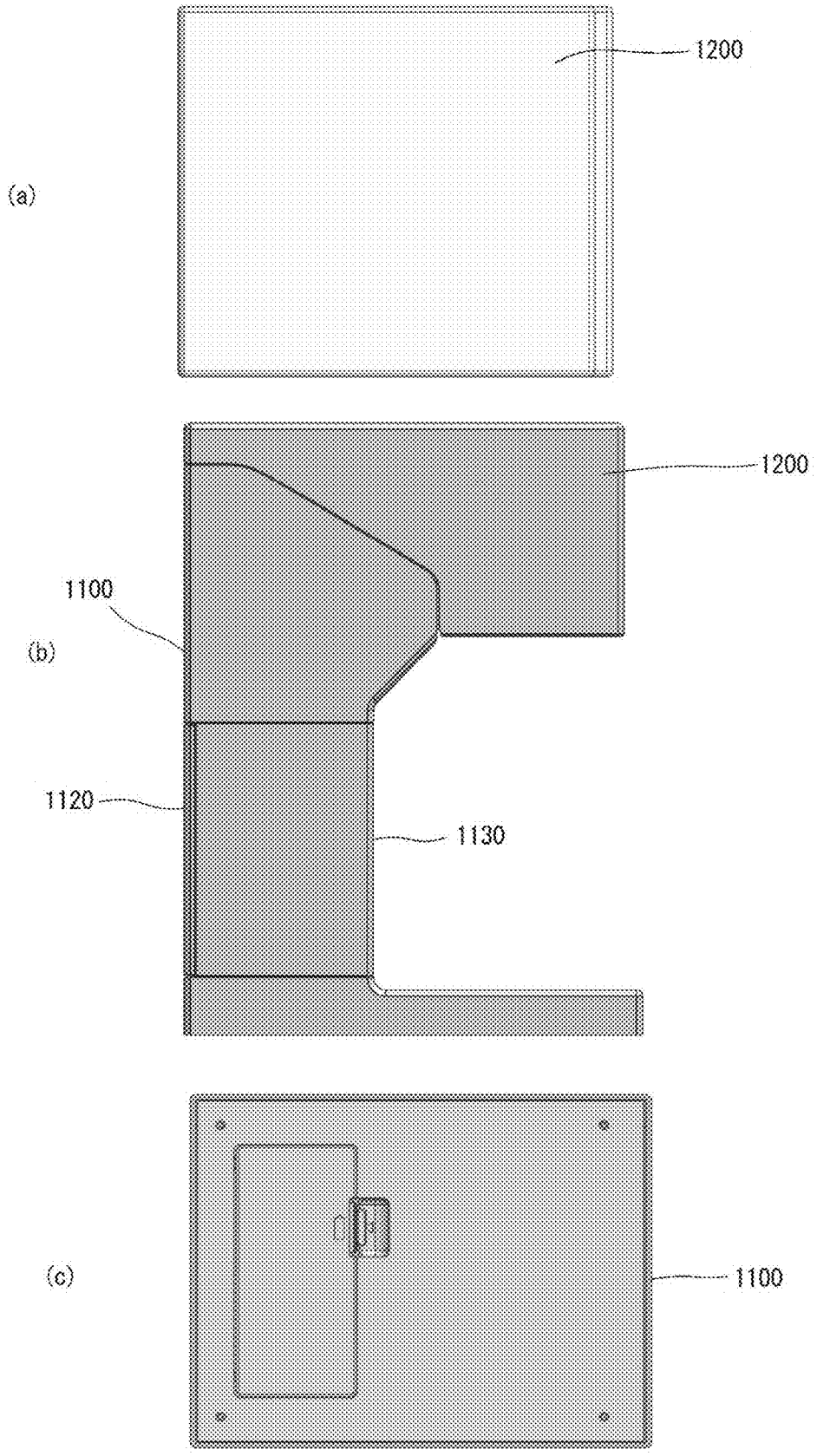
FIG. 19(*b*) is a side view of the sheet dispensing device according to the still another embodiment.
Figure 20:
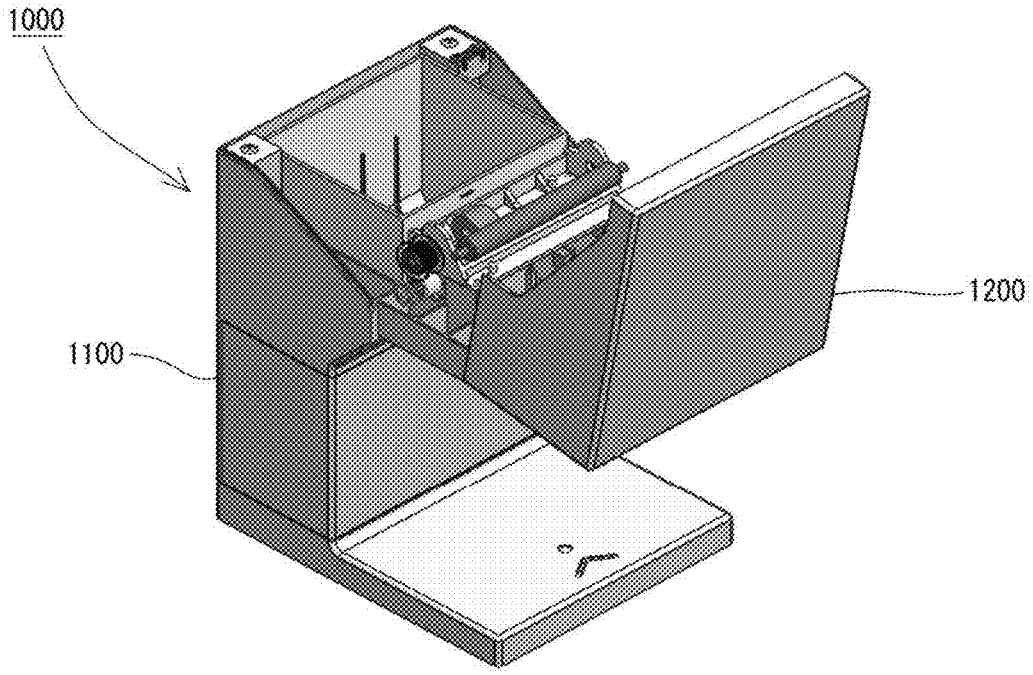
FIG. 20(*a*) is a perspective view of the sheet dispensing device according to the still another embodiment seen from the front upper direction with its lid being opened.
Figure 20:
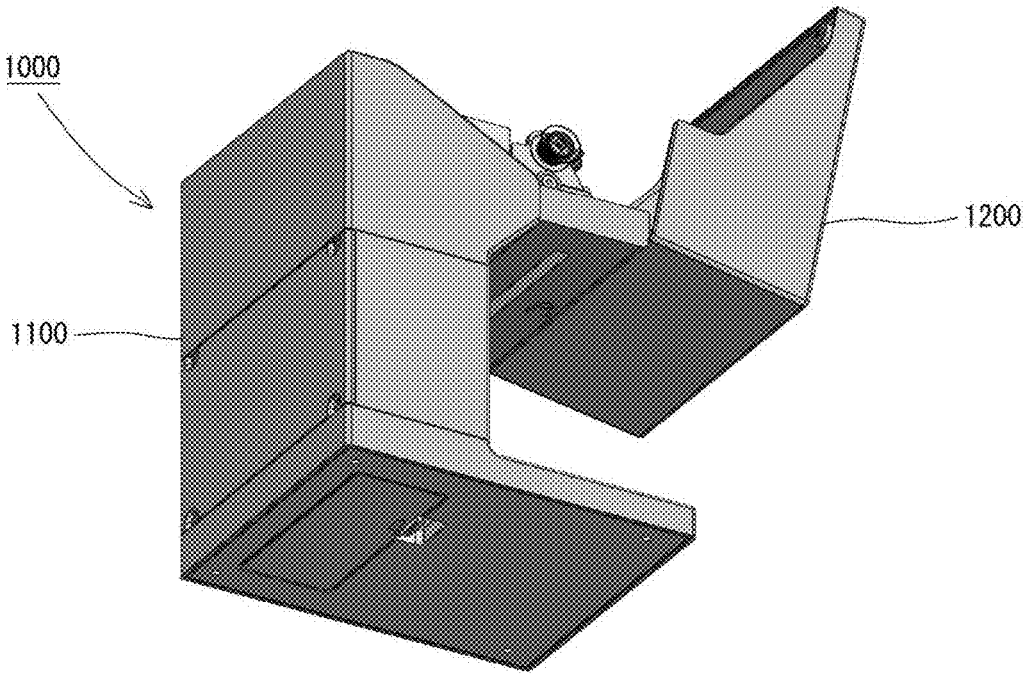

Further, the shape of the sheet dispensing device 1 is not limited to that shown in the above, and as illustrated in FIG. 16, it can have a sophisticated design if, for example, the side surfaces 114, 114 of the main body case 110 are constricted inward at their middles so as to be curved, and the front portion of the base 10*a* is substantially arc-shaped.

In the embodiments described above, as illustrated in FIG. 1 and so on, outwardly, the front side of the lid 120 is substantially arc-shaped in a plan view, and the main body case 110 has the curved front surface 113 formed in a substantially C shape whose substantially middle portion in terms of the height direction of the main body case 110 curves toward the rear surface, but the outer shape is not, of course, limited to this. FIG. 17 to FIG. 20 illustrate an example of a sheet dispensing device 1000 according to an embodiment where its outer shape is different, and its outer shape can be such that a lid 1200 is substantially rectangular in a plan view, and in a main body case 1100, a front surface 1130 located in front of a rear surface 1120 is not curved but is also substantially straight in a side view. It should be noted that the sheet dispensing device 1000 illustrated in FIG. 17 to FIG. 20 is completely the same in structure and function as the above-described embodiments, except for the outer shape.

INDUSTRIAL APPLICABILITY

The sheet dispensing device of the present invention is suitable for use not only in restrooms, washrooms, and so on where it is used by unspecified people but also in clinical sites, nursing and caring facilities, kitchens, seats of restaurants, hotels, department stores, seats of trains and airplanes, taxis, and so on that require high hygienic consideration.

The invention claimed is:

1. A sheet dispensing device comprising:

a casing capable of housing a rolled sheet inside and including a sheet dispensing port which is formed at a predetermined height position to face downward and through which the sheet passes when fed out; and a sheet feeding mechanism which is provided in the casing, wherein, when the sheet dispensing device is used, the sheet feeding mechanism feeds out a predetermined length for use of the sheet from the sheet dispensing port, and dispenses the predetermined length for use, in a hanging state from the sheet dispensing port while holding a part, of the sheet, located upstream of the sheet dispensing port in terms of a feeding direction of the sheet;

the sheet feeding mechanism further comprising:

a driving roller which is disposed upstream of the sheet dispensing port in terms of the feeding direction of the sheet and around whose outer peripheral surface the sheet is wound;

a driven roller which faces the driving roller to sandwich the sheet between the driven roller and the driving roller; and a drive control part which rotates the driving roller in such a direction as to feed the sheet toward the sheet dispensing port;

wherein the driven roller is supported by an elastic member to be elastically biased in a direction in which the driven roller approaches the driving roller, and, when the driving roller stops rotating, the part located upstream of the sheet dispensing port in terms of the feeding direction of the sheet is held while sandwiched between the driving roller and the driven roller;

wherein the drive control part includes a feed amount detecting part which controls an amount of the sheet fed per time to control the predetermined length for use that is to be hung down from the sheet dispensing port;

wherein the sheet has cutting lines extending between edges of the sheet and formed at predetermined intervals in the feeding direction; and wherein the drive control part stops driving the driving roller when the feed amount detecting part detects a predetermined number of the cutting lines in the feeding direction after the driving roller starts rotating;

the sheet dispensing devise further comprising:

a resistance applying part which applies a predetermined resistance to the sheet to widen slits forming the cutting lines when the sheet is transferred toward the sheet dispensing port;

a sheet cartridge disposed in the casing, housing the rolled sheet, and including a cover having a pullout port from which the sheet is pulled out, wherein an elastic contact piece which comes into contact with the sheet is provided as the resistance applying part at the pullout port; and a fracture preventing auxiliary roller provided between the elastic contact piece and the driving roller to prevent a fracture along the cutting line.

2. The sheet dispensing device according to claim 1, further comprising a sheet cartridge disposed in the casing, housing the rolled sheet, and including a cover having a pullout port from which the sheet is pulled out, wherein the sheet feeding mechanism pulls out the sheet out of the sheet cartridge from the pullout port and feeds the sheet to the sheet dispensing port.

3. The sheet dispensing device according to claim 2, wherein a rotation assisting means for assisting the rotation of the rolled sheet when the sheet is fed out is provided in the sheet cartridge.

4. The sheet dispensing device according to claim 1, wherein the fracture preventing auxiliary roller is provided at such a position as to make a range, of the sheet, from the pullout port to the fracture preventing auxiliary roller, extend substantially horizontally.

5. The sheet dispensing device according to claim 1, wherein the casing includes:

a main body case in which the sheet cartridge is disposed and which has the sheet dispensing port; and a lid which is capable of separating from and coming into contact with the main body case and covers, from above, the sheet that is present at least in a range from the pullout port of the sheet cartridge from which the sheet has been pulled out up to the sheet dispensing port, wherein the driving roller and the driven roller are supported by one and the other of the main body case and the lid respectively, and wherein, when the lid is joined to the main body case, the driving roller and the driven roller face each other with the sheet therebetween.

6. The sheet dispensing device according to claim 1, wherein the drive control part has a detecting sensor which is attached to an appropriate part of the casing to detect the presence of a user and the drive control part rotates the driving roller when the detecting sensor detects the presence of the user.

7. The sheet dispensing device according to claim 1, wherein the sheet is a wet sheet.

8. The sheet dispensing device according to claim 1, wherein the casing includes an information display part.

9. The sheet dispensing device according to claim 1, the sheet dispensing device being connectable to a mobile terminal including an information display part.

* * * * *